US011574789B2

(12) United States Patent
Sullivan et al.

(10) Patent No.: US 11,574,789 B2
(45) Date of Patent: Feb. 7, 2023

(54) ELECTRICAL CONNECTORS FOR MULTIPLE EMITTER CATHODES

(71) Applicant: VAREX IMAGING CORPORATION, Salt Lake City, UT (US)

(72) Inventors: Jacob Sullivan, Syracuse, UT (US); Santosh Ramachandran, Salt Lake City, UT (US); Evgeny Galyaev, Salt Lake City, UT (US); Gregory C. Andrews, West Jordan, UT (US); Christopher Lewis, Kaysville, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 406 days.

(21) Appl. No.: 15/717,389

(22) Filed: Sep. 27, 2017

(65) Prior Publication Data

US 2018/0211810 A1 Jul. 26, 2018

Related U.S. Application Data

(60) Provisional application No. 62/451,056, filed on Jan. 26, 2017.

(51) Int. Cl.

| | |
|---|---|
| ***H01J 35/06*** | (2006.01) |
| ***H01J 35/14*** | (2006.01) |
| ***H05G 1/70*** | (2006.01) |

(52) U.S. Cl.

CPC ..... *H01J 35/064* (2019.05); *H01J 35/147* (2019.05); *H01J 2235/068* (2013.01); *H05G 1/70* (2013.01)

(58) Field of Classification Search

CPC ..... H01J 35/06; H01J 35/14; H01J 35/025; H01J 35/04; H01J 35/064; H01J 35/147; H01J 2235/068; H05G 1/70

See application file for complete search history.

(56) References Cited

U.S. PATENT DOCUMENTS

| | | | |
|---|---|---|---|
| 3,649,861 | A | 3/1972 | Atlee et al. |
| 4,065,689 | A | 12/1977 | Pleil |

(Continued)

FOREIGN PATENT DOCUMENTS

| | | | |
|---|---|---|---|
| JP | S55137453 | U | 9/1980 |
| JP | S63-138639 | A | 6/1988 |
| JP | 2004-528682 | A | 9/2004 |

OTHER PUBLICATIONS

Partial European Search Report dated Jun. 27, 2018, in EP Application No. 18153672.3; 6 pages.

(Continued)

*Primary Examiner* — Blake C Riddick

(74) *Attorney, Agent, or Firm* — Laurence & Phillips IP Law

(57) ABSTRACT

In some embodiments, a cathode assembly may include a cathode head that has a first electron emitter and a second electron emitter. The first electron emitter may have a first connection location and a second connection location. The second electron emitter may have a third connection location and a fourth connection location. The third connection location may be electrically coupled with the second connection location of the first electron emitter. The cathode assembly may include a receptacle having a first connector and a second connector. The first connector may be electrically coupled with the first connection location of the first electron emitter. The second connector may be electrically coupled with the second connection location of the first electron emitter and the third connection location of the second electron emitter. The third connector may be electrically coupled with the fourth connection location of the second electron emitter.

16 Claims, 15 Drawing Sheets

(56) References Cited

U.S. PATENT DOCUMENTS

| | | | | |
|---|---|---|---|---|
| 4,315,154 | A | 2/1982 | Weigl et al. | |
| 4,685,118 | A * | 8/1987 | Furbee | H01J 35/06 378/114 |
| 4,799,248 | A | 1/1989 | Furbee et al. | |
| 5,901,197 | A | 5/1999 | Khutoryansky et al. | |
| 2002/0126798 | A1 | 9/2002 | Harris et al. | |
| 2004/0028184 | A1 * | 2/2004 | Hansen | H01R 33/7678 378/123 |
| 2017/0287669 | A1 * | 10/2017 | Steinlage | H01J 35/06 |
| 2018/0211809 | A1 | 7/2018 | Burke et al. | |

OTHER PUBLICATIONS

Rolf Behling: "Technology, Manufacturing, Reliability" In: "Modern Diagnostic X-Ray Sources", May 26, 2015, CRC Press, Boca Raton London New York, XP055485527, ISBN: 978-1-4822-4133-1 (pp. 202-203; figure 6.19 / pp. 329-331; figures 8.2,8.3).

* cited by examiner

ELECTRICAL CONNECTORS FOR MULTIPLE EMITTER CATHODES

CROSS-REFERENCE TO RELATED APPLICATIONS

This application claims the benefit of U.S. Provisional Patent Application No. 62/451,056, filed Jan. 26, 2017, which is incorporated herein by reference in its entirety.

BACKGROUND

The present disclosure generally relates to cathode assemblies for X-ray tubes. In particular, the disclosure may relate to electrical connection configurations for cathode assemblies of X-ray tubes.

X-ray tubes are used in a variety of industrial and medical applications. For example, X-ray tubes are employed in medical diagnostic examination, therapeutic radiology, semiconductor fabrication, and material analysis. More specifically, X-ray tubes are often used in computed tomography (CT) or X-ray imaging systems to analyze patients in medical imaging procedures or objects during package scanning.

During operation of a typical X-ray tube, an electrical current may be supplied to an electron emitter, or filament, of a cathode. This causes electrons to be formed on the emitter via a process known as thermionic emission. The electrons accelerate from the emitter toward a target track formed on the anode in the presence of a high voltage differential applied between the anode and the cathode. Upon striking the anode, some of the resulting kinetic energy from the striking electrons is converted into X-rays. The region of the anode upon which the majority of the electrons collide is generally referred to as a "focal spot." The resulting X-rays may then pass through an X-ray transmissive window and are directed towards a patient or other object to be examined. In a typical environment, an image is generated based on the X-rays that pass through the patient/object. While a number of factors affect the quality of a resulting image, one factor is the size, quality and/or energy level of the electrons in the focal spot region.

The claimed subject matter is not limited to embodiments that solve any disadvantages or that operate only in environments such as those described above. This background is only provided to illustrate examples of where the present disclosure may be utilized.

DETAILED DESCRIPTION

The present disclosure generally relates to cathode assemblies for X-ray tubes. In particular, the disclosure may relate to electrical connection configurations for cathode assemblies of X-ray tubes.

In an X-ray tube, electrons are typically generated using an electron emitter, typically implemented with a filament of a cathode. In the presence of a voltage differential, the electrons may then be accelerated towards a focal spot region on a target surface formed on an anode, and upon striking the target surface, some of the resulting energy generated from the electron collision with the anode is converted into X-rays. The X-rays generated by the X-ray tube may then be directed to a patient or an object for analysis or treatment.

Figure 1A:
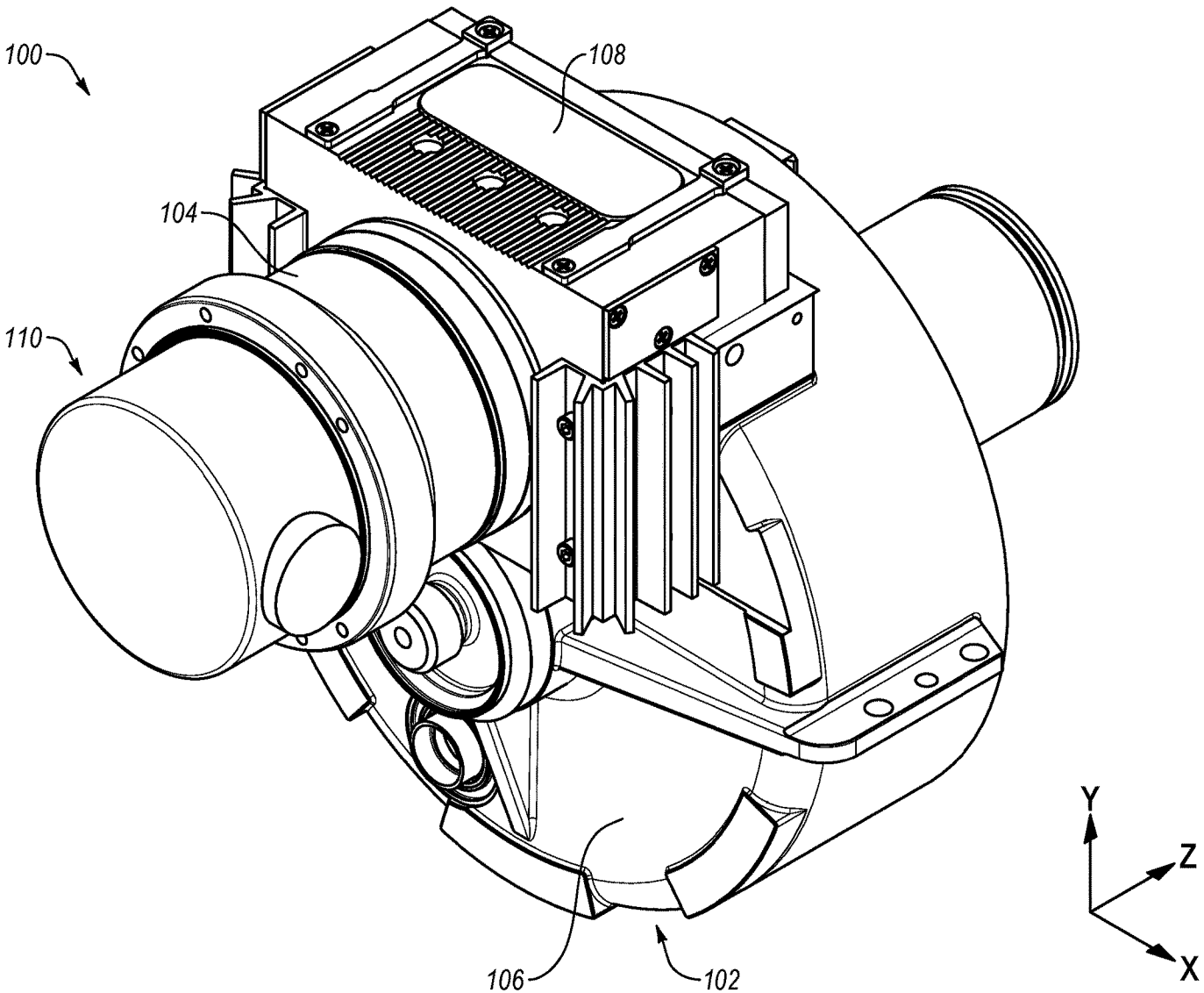
FIG. 1A is a perspective view of an example X-ray tube.
Figure 1B:
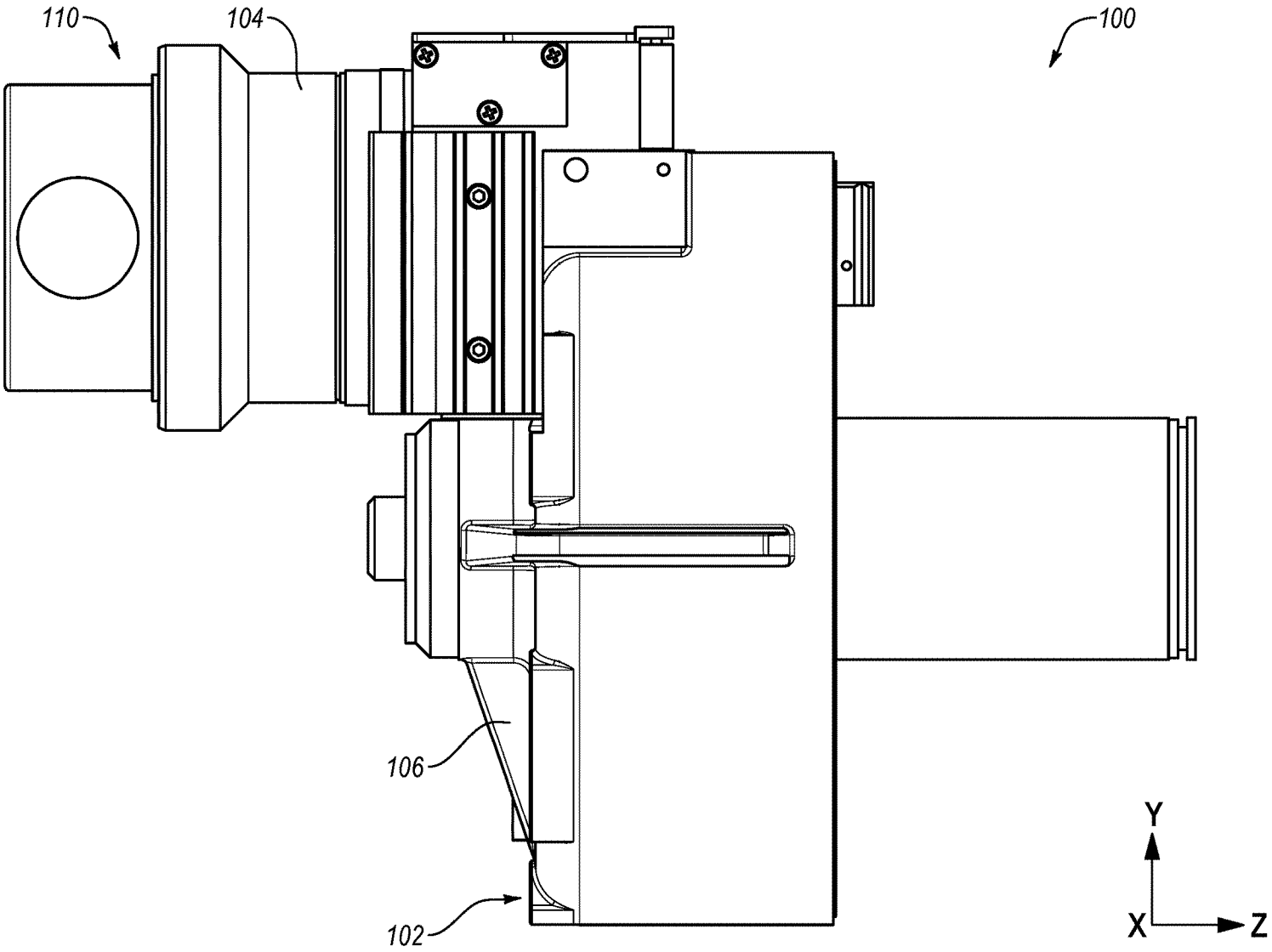
FIG. 1B is a side view of the X-ray tube of FIG. 1A.
Figure 1C:
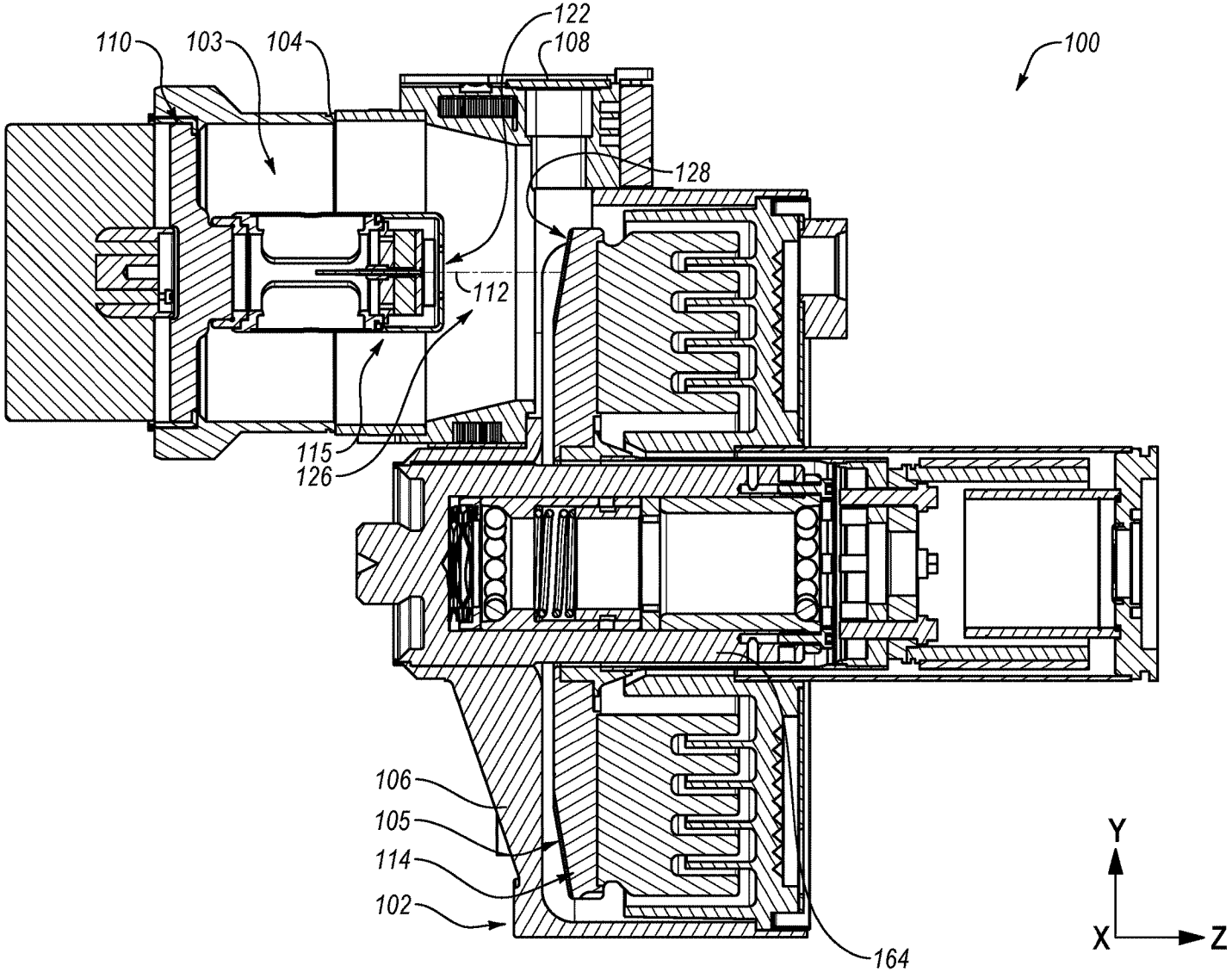
FIG. 1C is a cross-sectional view of the X-ray tube of FIG. 1A.

FIGS. 1A-1C are views of one example of an X-ray tube 100 in which one or more embodiments described herein may be implemented. Specifically, FIG. 1A depicts a perspective view of the X-ray tube 100 and FIG. 1B depicts a side view of the X-ray tube 100, while FIG. 1C depicts a cross-sectional view of the X-ray tube 100. The X-ray tube 100 illustrated in FIGS. 1A-1C represents an example operating environment and does not limit the embodiments disclosed herein.

Generally, X-rays are generated within the X-ray tube 100, some of which then exit the X-ray tube 100 to be utilized in one or more applications. The X-ray tube 100 may include a vacuum enclosure structure 102 which may act as the outer structure of the X-ray tube 100. The vacuum enclosure structure 102 may include a cathode housing 104 and an anode housing 106. As illustrated in FIG. 1C, the cathode housing 104 may be secured to the anode housing 106 such that an interior cathode volume 103 is defined by the cathode housing 104 and an interior anode volume 105 is defined by the anode housing 106, each of which are joined so as to define a vacuum envelope.

As shown in FIGS. 1A and 1C, the X-ray tube 100 may include an X-ray transmissive window 108. Some of the X-rays that are generated in the X-ray tube 100 may exit through the window 108. The window 108 may be composed of beryllium or another suitable X-ray transmissive material.

With reference to FIG. 1C, the cathode housing 104 forms a portion of the X-ray tube referred to as a cathode assembly 110. The cathode assembly 110 generally includes components that relate to the generation of electrons that together form an electron beam, 112. For example, the cathode assembly 110 may include a cathode head 115 having an electron emitter system 122, disposed at an end of the cathode head 115.

Positioned within the anode interior volume 105 defined by the anode housing 106 is the anode 114. The anode 114 is spaced apart from and opposite to the cathode assembly 110. When an electrical current is applied to the electron emitter system 122, the electron emitter system 122 is configured to emit electrons via thermionic emission, that together form the electron beam 112 that accelerates towards a target 128 of the anode 114.

The electrons emitted by the electron emitter system 122 form an electron beam 112 and enter and traverse through an acceleration region 126 and accelerate towards the anode 114. More specifically, according to the arbitrarily-defined coordinate system included in FIGS. 1A-1C, the electron beam 112 may accelerate in a z-direction, away from the electron emitter system 122 in a direction through the acceleration region 126.

In the illustrated configuration, the anode 114 is a rotating anode configured to rotate via a rotatably mounted shaft 164 coupled to a bearing assembly or other suitable structure. As the electron beam 112 is emitted from the electron emitter system 122, electrons impinge upon the target 128 of the anode 114. In this embodiment, the target 128 is shaped as an annular ring positioned on the rotating anode 114. The region in which a large concentration of the electron beam 112 impinges on the target surface 128 is known as a focal spot. The target surface 128 may be composed of tungsten or a similar material having a high atomic ("high Z") number. A material with a high atomic number may be used for the target 128 so that the material will correspondingly include electrons in "high" electron shells that may interact with the impinging electrons to generate X-rays. Although in this embodiment the anode 114 is a rotating anode, the concepts described herein may be applied in other anode configurations, such as a stationary anode.

During operation of the X-ray tube 100, the anode 114 and the electron emitter system 122 are connected in an electrical circuit. The electrical circuit allows the application of a high voltage potential between the anode 114 and the electron emitter system 122. Additionally, the electron emitter system 122 is connected to a power source that directs electrical current to filaments or emitters of the electron emitter system 122 to cause electrons to be generated by thermionic emission. The application of a high voltage differential between the anode 114 and the electron emitter system 122 causes the emitted electrons to form an electron beam 112 that accelerates through the acceleration region 126 towards the target 128. As the electrons within the electron beam 112 accelerate, the electron beam 112 gains kinetic energy. Upon striking the target 128, some of this kinetic energy is converted into X-rays. The target 128 is oriented such that the X-rays may pass through the window 108 and exit the X-ray tube 100 via the window 108.

In some embodiments, the vacuum enclosure 102 may be disposed within an outer housing (not shown) within which a coolant, such as liquid or air, is circulated so as to dissipate heat from the external surfaces of the vacuum enclosure 102. An external heat exchanger (not shown) may be operatively connected so as to remove heat from the coolant and recirculate it within the outer housing. In some configurations, the cathode housing 104, the anode housing 106 or components of the X-ray tube 100 may include coolant passageways.

In some embodiments, the X-ray tube 100 may include one or more electron beam manipulation components. Such components can be implemented to "focus," "steer" and/or "deflect" the electron beam 112 before it traverses the region 126, thereby manipulating or "toggling" the dimension and/or the position of the focal spot on the target surface 128. Additionally or alternatively, a manipulation component or system can be used to alter or "focus" the cross-sectional shape (e.g., length and/or width) of the electron beam and thereby change the shape and dimension of the focal spot on the target 128. In some configurations, the components configured to "focus," "steer" and/or "deflect" the electron beam may be located on the cathode head 115 and/or the cathode assembly 110.

Figure 2:
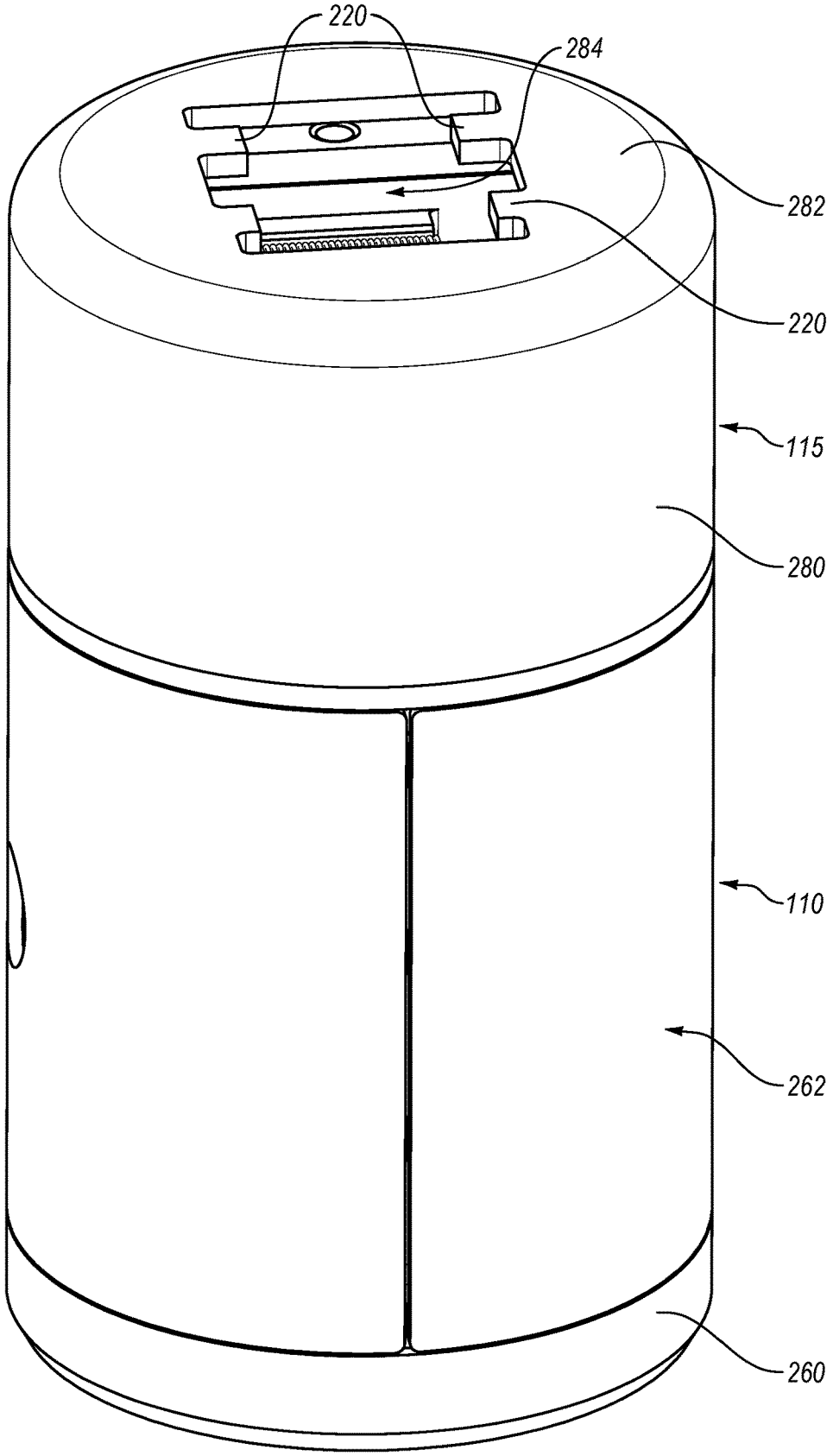
FIG. 2 is a perspective view of an embodiment of a cathode assembly.

FIG. 2 is a perspective view of an embodiment of the cathode assembly 110. With reference to FIG. 2, aspects of the cathode assembly 110 will be described in further detail. As illustrated, the cathode assembly 110 includes a bottom portion 260, a middle portion 262, and a top portion 280. The top portion 280 includes a surface 282 with an aperture 284 formed therein. The top portion 280 defines an internal cavity with the cathode head 115 positioned therein. In such configurations, the top portion 280 may be referred to as a cathode shield. The electron emitter system 122 of the cathode head 115 is positioned and oriented to emit electrons through the shield aperture 284 in a beam 112 towards the anode 114 (see FIG. 1C).

The cathode assembly 110 may include focusing tabs 220 configured to provide beam focusing and/or steering. The focusing tabs 220 may be positioned on the top portion 280 on the surface 282 extending into the aperture 284. In some embodiments, a pair of the focusing tabs 220 may be included for each corresponding filament or emitter of the cathode head 115. Each pair of the focusing tabs 220 may be configured to impose spatial limitations on the corresponding electron beam so as to focus the electron beam by providing a desired focal spot shape and size. Additionally or alternatively, each pair of the focusing tabs 220 may be configured to steer a corresponding electron beam by positioning the focal spot on an anode target. In other configurations, the focusing tabs 220 may not be included as part of the cathode assembly 110 and focusing and/or steering structure may be provided on the cathode head itself. An example of such configurations is illustrated in FIGS. 3A-3C.

Figure 3A:
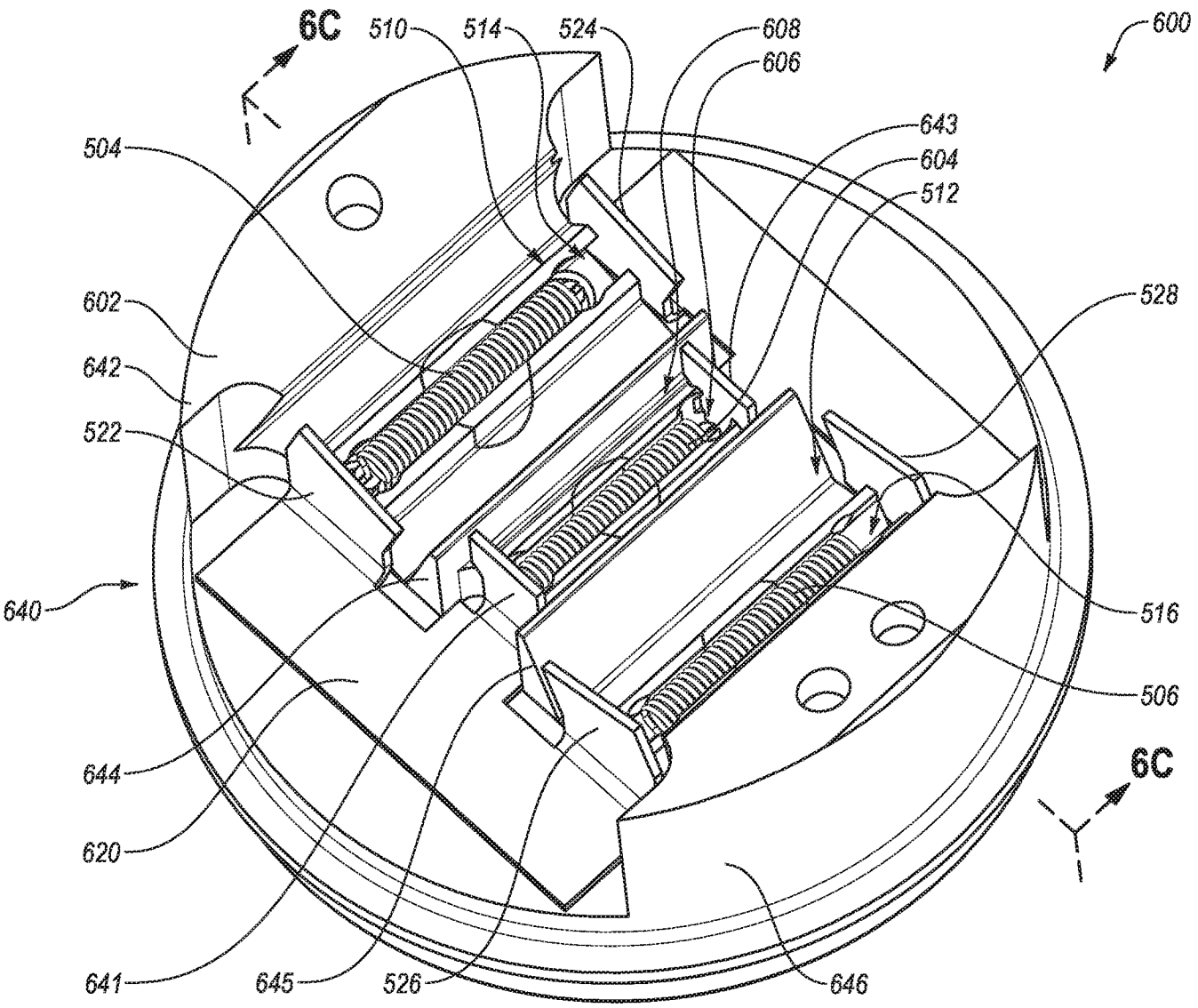
FIG. 3A is a top perspective view of an embodiment of a cathode head.
Figure 3B:
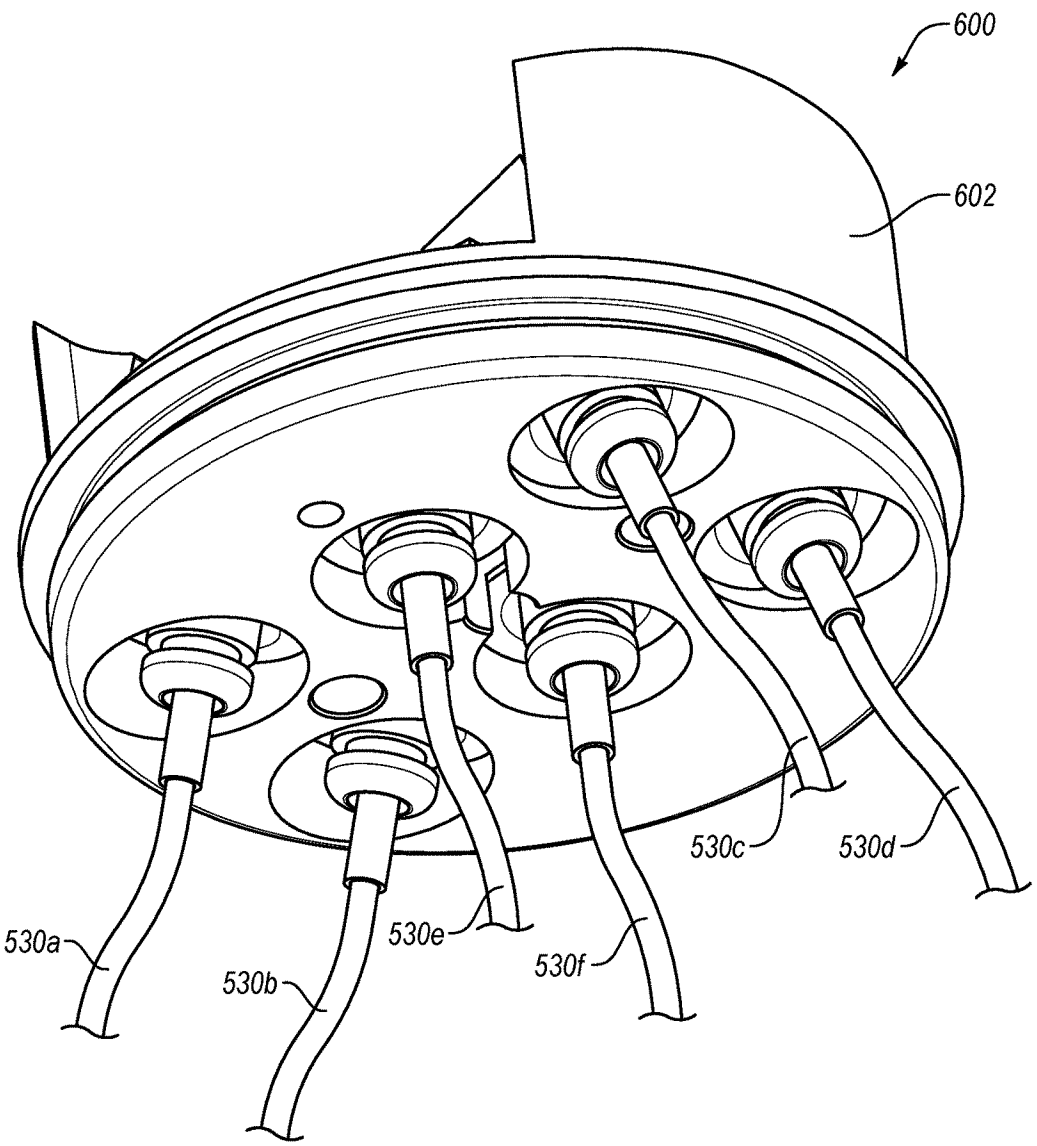
FIG. 3B is a bottom perspective view of the cathode head of FIG. 3A.
Figure 3C:
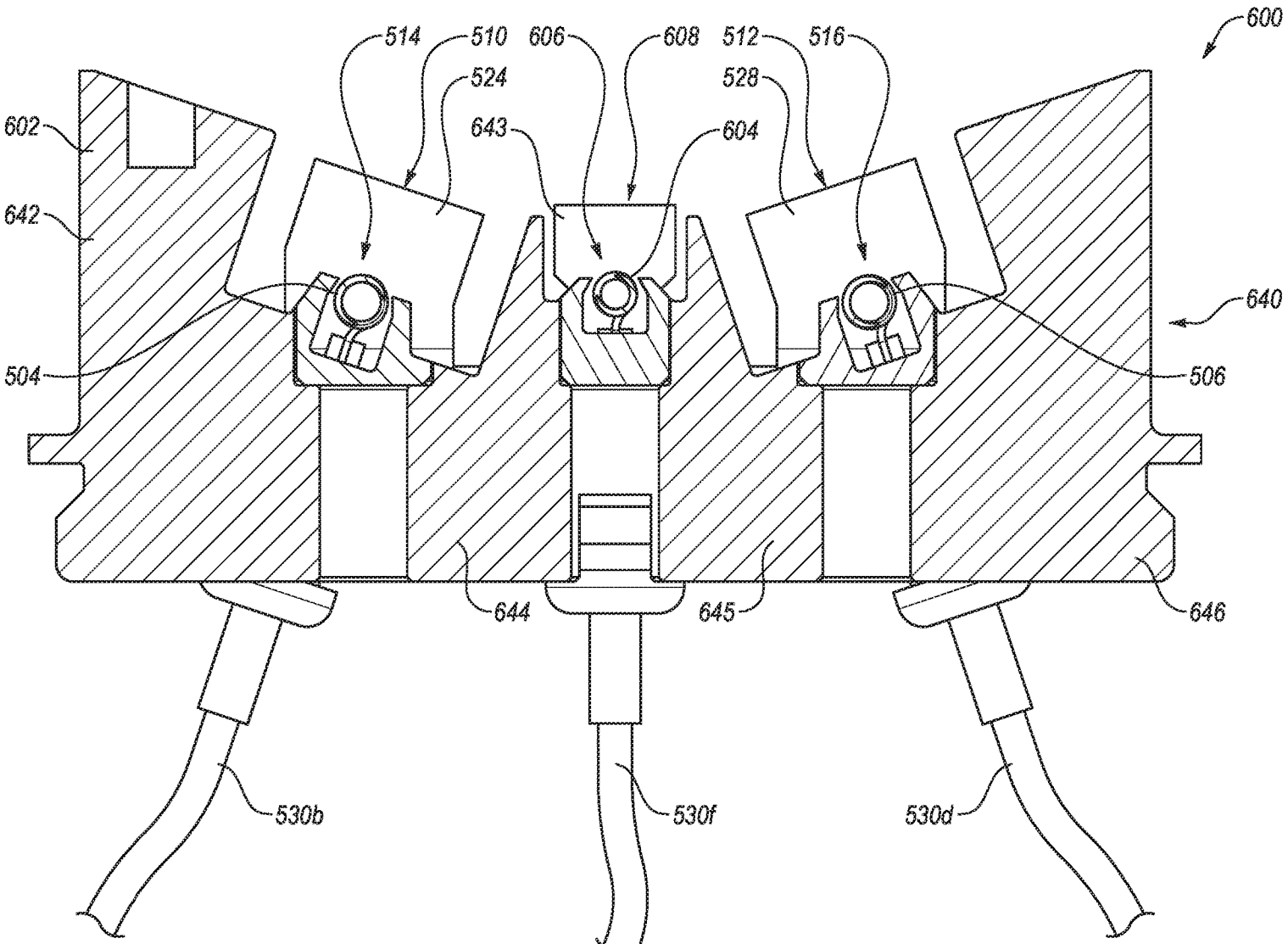
FIG. 3C is a cross-section view of the cathode head of FIG. 3A.

FIGS. 3A-3C illustrate an example embodiment of a cathode head 600. FIG. 3A is a top perspective view the cathode head 600, FIG. 3B is a bottom perspective view the cathode head 600, and FIG. 3C is a cross-section view of the cathode head 600. The cathode head 600 may be implemented in the X-ray tube 100 of FIGS. 1A-1C and 2. Any suitable aspects described with respect to the cathode head 600 may be included in the other embodiments described herein.

As illustrated, the cathode head 600 includes a cathode body 602, a first filament 504, a second filament 506, and third filament 604. The filament 604 is positioned between the filament 504 and the filament 506. The filaments 504, 506, 604 are spaced apart from one another. In the illustrated configuration, the filaments 504, 506, 604 are coil filaments formed of a wire arranged in a spiral or helical configuration. In the illustrated configuration, the filaments 504 and 506 are substantially the same size, and the filament 604 is smaller than the filaments 504, 506, although other configurations may be implemented.

The cathode body 602 defines a first filament recess, implemented here as filament slot 514, a second filament recess, shown as filament slot 516, and a third filament recess, shown as filament slot 606. In the illustrated embodiment, the filament 504 is positioned at least partially inside the filament slot 514, the second filament 506 is positioned at least partially inside the filament slot 516, and the third filament 604 is positioned at least partially inside the filament slot 606.

The cathode body 602 also defines a first focusing recess, implement as focusing slot 510, a second focusing recess, shown as focusing slot 512, and a third focusing recess, shown as focusing slot 608. The filament 504 and the filament slot 514 are positioned inside of the focusing slot 510, the filament 506 and the filament slot 516 are positioned inside of the focusing slot 512, and the filament 604 and the filament slot 606 are positioned inside of the focusing slot 608. The focusing slot 510 may be sized and shaped to focus and/or direct an electron beam produced by the filament 504, the focusing slot 512 may be sized and shaped to focus and/or direct an electron beam produced by the filament 506, and the focusing slot 608 may be sized and shaped to focus and/or direct an electron beam produced by the filament 604.

In some configurations, the filament 504, the filament slot 514, and the focusing slot 510 may be aligned with respect to one another such that they each share a common axis. Similarly, the filament 506, the filament slot 516, and the focusing slot 512 may be aligned with respect to one another such that they each share a second common axis. The filament 604, the filament slot 606, and the focusing slot 608 may be aligned with respect to one another such that they each share a common axis. In some configurations, the common axis may be a longitudinal axis of the cathode body 602. In other configurations, the components may not be aligned and may be oriented in other suitable configurations.

In the configuration illustrated in FIGS. 3A-3C, the filaments 504 and 506 are spaced apart from one another and are configured to operate simultaneously and simultaneously direct electrons to a target on an anode (see, for example, FIG. 1C). The filaments 504, 506, the filament slots 514, 516, and the focusing slots 510, 512 are oriented toward a common target. Specifically, the focusing slot 510 may be angled with respect to the focusing slot 512 toward a common target such that an electron beam from the filament 504 and an electron beam from the filament 506 intersect generally at the common target. Similarly, the filament slot 514 may be angled with respect to the filament slot 516 such that an electron beam from the filament 504 and an electron beam from the filament 506 are directed to a common target.

While the filaments 504 and 506 are configured to operate simultaneously and simultaneously direct electrons to a target on an anode, the filament 604 may be configured to operate independently of the filaments 504 and 506. As such, the filament 604 may be configured to activate when the filaments 504 and 506 are deactivated, or vice versa. Notwithstanding, the filament 604, the filament slot 606, and the focusing slot 608 may be configured to form a focal spot on a target in a same or similar area as the focal spots formed by the filaments 504 and 506. Accordingly, the filaments 504, 506, 604 the filament slots 514, 516, 606 and the focusing slots 510, 512, 608 may be oriented toward a common target. Specifically, the focusing slots 510, 512 may be angled toward a common target such that electron beams from filaments 504, 506, and 604 are generally directed at the common target. In other configurations, all three of the filaments 504, 506, and 604 may be configured to operate simultaneously, individually, or any suitable configuration.

As mentioned, the filament 604 may be smaller than the filaments 504, 506. The filament 604 may include at least one dimension smaller than the filament 504 and/or the filament 506. For example, the filament 604 may include an overall length, coil length, filament diameter, coil diameter, or other dimension that is smaller than a corresponding dimension of the filament 504 and/or the filament 506. Additionally or alternatively, the filament 604 may operate at different current and/or voltage levels than the filaments 504, 506. Thus, the focal spot produced by the filament 604 may be a different size (e.g., one or more dimensions smaller) than the focal spots produced by the filaments 504, 506, or the combined focal spot produced by both of the filaments 504, 506. In other configurations, the filament 604 may be substantially the same size as the filaments 504, 506, or each of the filaments 504, 506, 604 may be different sizes.

As mentioned above, the filament 504 may be positioned at least partially inside the filament slot 514 and the second filament 506 is positioned at least partially inside the filament slot 516. As illustrated in FIG. 3C, the filament 506 may be positioned to extend further out of the filament slot 516 than the emitter 504 extends out of the filament slot 514. In such configurations, the surface area that emits electrons on the filament 506 is greater than the surface area that emits electrons on the filament 504, even though the size of the filaments 504, 506 are substantially the same. Accordingly, the filament 506 produces an electron beam that has a larger cross-section than a cross-section of the electron beam produced by the filament 504. Specifically, the electron beam produced by the filament 506 is wider or more spread out than the electron beam produced by the filament. In turn, the focal spot produced on the target by the filament 506 may be larger than the focal spot produced by the filament 504. In some configurations, the respective focal spots of the filaments 504, 506 may overlap one another. In some overlapping configurations, the smaller focal spot of the filament 504 may be positioned partially or entirely within the larger focal spot of filament 506.

In some configurations, the cathode head 600 may include a focusing and/or steering structure (generally referred to as a "focusing structure"). The "focusing" may provide a desired focal spot shape and size, and the "steering" may change the positioning of the focal spot on the anode target. The focusing structure may at least partially surround the filaments 504, 506, 604 and may focus and/or steer the electron beams emitted by the filaments 504, 506, 604 by imposing electrical fields and/or spatial limitations on the electron beams.

In the illustrated configuration, the focusing structure includes a focusing grid 640 that includes a first grid member 642, a second grid member 644, a third grid member 645, and a fourth grid member 646. The combination of the first grid member 642 and the second grid member 644 forms a first focusing grid pair, the combination of the second grid member 644 and third grid member 645 forms a second focusing grid pair, and the combination of the third grid member 645 and fourth grid member 646 forms a third focusing grid pair.

As best illustrated in FIG. 3C, the first grid member 642 and the second grid member 644 includes the filament 504 positioned therebetween, the second grid member 644 and the third gird member includes the filament 604 positioned therebetween, and the third grid member 645 and fourth grid member 646 includes the filament 506 positioned therebetween. The focusing grid 640 may be configured to receive a grid voltage to focus electrons emitted by the filaments 504, 506, 604. Particularly, the focusing grid 640 may focus the electron beam in one direction perpendicular to the beam path, and/or steer the beam in that same direction perpendicular to the beam path. The voltages of the grid members 642, 644, 645, and 646 can be modulated so as to provide a beam with a given dimension. Specifically, the voltage difference between the two grid members for each coil filament may be modulated to change one or more cross-sectional dimension of the electron beam.

Additionally or alternatively, the focusing structure may include a second focusing grid 620. The focusing grid 620 may include focusing tab pairs corresponding to each of the filaments 504, 506, 604. The focusing grid 620 includes the first tab pair formed of a first tab 522 and a second tab 524 with the filament 504 positioned therebetween. The focusing grid 620 also includes the second tab pair formed of the third tab 526 and the fourth tab 528 with the filament 506 positioned therebetween. In addition, the focusing grid 620 includes a third tab pair formed of a fifth tab 641 and a sixth tab 643 with the filament 604 positioned therebetween.

The focusing grid 620 may be configured to receive a grid voltage to focus electrons emitted by the filaments 504, 506, 604. The focusing tabs 522, 524, 526, 528, 641, and 643 may form focusing grid pairs and may receive a voltage difference to focus and/or steer the electron beam in a direction orthogonal to the focusing grid 640. The voltages of the focusing tabs 522, 524, 526, 528, 641, and 643 can be modulated so as to provide a beam with a given dimension. Specifically, the voltage difference between the two tabs for each coil filament may be modulated to change one or more cross-sectional dimension of the electron beam. In other configurations, the focusing tabs 522, 524, 526, 528, 641, and 643 may impose spatial limitations on corresponding electron beams rather than providing focusing and/or steering electrostatically.

In some circumstances, the focusing grid 620 and/or the focusing grid 640 may be used to "cut off" the electron beam by providing a sufficiently large voltage to prevent the electron beam from reaching the target and/or the focal spot. Accordingly, the focusing grid 620 and/or the focusing grid 640 may be used to control the emission of X-rays from the X-ray tube by cutting off electron beams from the filaments 504, 506, 604.

The embodiments described herein may be implemented with any suitable focusing structure, such as a magnetic, electrostatic, or combination thereof. The described embodiments may be implemented using a single electrostatic focusing grid or multiple grid configurations (e.g., dual grids). Although in the illustrated configuration the focusing structure includes two focusing grids 620, 640, in other configurations only one or the other may be included.

In configurations where two filaments are operated simultaneously to create a focal spot with greater electron intensity, it may be easier to implement and use a focusing structure to focus and/or steer the electron beams when compared to single filament configurations that produce focal spot with same or similar intensities. Particularly, each filament may require less current and/or voltage to create a focal spot with greater electron intensity, because electrons from both of the filaments are aggregated. Since the filaments may be operating at lower current and voltage levels, less voltage may be required in a focusing grid to sufficiently focus and/or steer the electron beams. Similarly, a lower voltage may be required to "cut off" the electron beam. In contrast, in configurations where a larger filament is used, or greater current or voltage is applied to the filament, a larger grid voltage may be required to focus and/or steer the electron beams. In addition, when two or more similar or identical filaments are operated simultaneously, a single grid voltage may be used to focus and/or steer each of the respective electron beams. In contrast, filaments of different sizes may require using separate grid voltages for each.

The embodiments described herein may be implemented with any suitable focusing structure, such as a spatial, magnetic, electrostatic, or combination thereof. The described embodiments may be implemented using a single electrostatic focusing grid or multiple grid configurations (e.g., dual grids). In other configurations, embodiments may not include electrostatic focusing and may rely on other suitable focusing structures, such as spatial and/or magnetic. Although in the illustrated configuration the focusing structure includes two focusing grids, in other configurations only one may be included.

As best shown in FIG. 3B, the cathode head 600 may include electrical couplings 530*a*, 530*b*, 530*c*, 530*d*, 530*e*, and 530*f*. The electrical couplings 530*a-f* may extend through the cathode body 602 to couple the filaments 504, 506, 604. A power source may be electrically coupled to the filament 504, the filament 506, and the filament 604 via the electrical couplings 530*a-f*. Particularly, the electrical couplings 530*a-f* may extend through the cathode body 602 to couple the filaments 504, 506, 604. Each of the filaments 504, 506, 604 may include a corresponding pair of electrical couplings. For example, electrical couplings 530*a* and 530*b* may correspond to filament 504, electrical couplings 530*c* and 530*d* may correspond to filament 506, and electrical couplings 530*e* and 530*f* may correspond to filament 604. Although not illustrated, electrical couplings may be provided to electrically couple the focusing structure.

The power source may simultaneously direct electrical current to the filaments 504, 506 such that the filaments 504, 506 simultaneously produce electrons that are directed to the focal spot or the target on the anode. In some configurations, the power source may be configured to operate the filaments 504, 506 at substantially the same current and/or voltage levels, although other configurations may be implemented. The filaments 504, 506 may be connected to the power source either in series or in parallel, depending on the desired configuration. The power source may direct electrical current to the filament 604 independently of the filaments 504, 506, such that the filament 604 produces electrons when the filaments 504, 506 are not activated, and vice versa. In some configurations, the power source may be configured to operate the filaments 504, 506 at different current and/or voltage level than the filament 604.

Although the illustrated configuration includes three filaments 504, 506, 604, other configurations may include any suitable number of filaments. For example, some configurations may not include the filaments 604. Other configurations may include three or more filaments of the same size, or different sizes.

In disclosed embodiments, cathode assemblies may include more than one filament (which may also be referred to as "emitters" or "electron emitters"). In some configurations, multiple filaments are operated simultaneously to direct electron beams toward a common focal spot on the anode. Such configurations may thus increase the amount of electrons produced by the cathode, or increase the rate that electrons are emitted by the cathode. This increases the number of electrons striking the anode, thereby increasing the amount of X-rays generated and emitted from the X-ray tube. Increasing the X-rays emitted from the X-ray tube may provide various advantages for X-ray imaging. For example, increasing the rate of X-ray emission may be used for quicker scanning of objects or patients. In another example, increasing the rate of X-ray emission may be used to provide improved penetration through patients or objects.

Other embodiments may include configurations that steer or focus the stream of electrons. Such features may be referred to as a "focusing" and/or "steering" structure. Focusing an electron beam may provide a desired focal spot shape and size, and steering may change the positioning of the focal spot on the anode target. The focusing structure may focus and/or steer the electron beams emitted by the filaments by imposing electrical fields and/or spatial limitations on the electron beams. In other configurations, the focusing structure may focus and/or steer using magnetic fields. In some circumstances, the focusing structure may be provided as part of the cathode assembly, for example, on a cathode head of the cathode assembly.

In disclosed embodiments, cathode assemblies are driven by a power source such as a generator. The generator provides electrical current to the one or more of the filaments 504, 506, 604. Additionally, the generator may power the focusing structure, in configurations where the focusing structure is electrically driven. The generator may be a high-voltage generator that steps up voltage from another power source.

In various circumstances, the same multiple filament cathode assembly may be used in different configurations depending on the needs of a given application and/or the available equipment. For example, the multiple filament cathode assembly may be used in either single filament configurations (e.g., filament 604) or multiple filament configurations (e.g., filaments 504, 506). As used herein, "single filament configurations" refers to configurations where a single filament of a multiple filament cathode assembly is operated at a given moment, and the remaining filaments are not operated. As used herein, "multiple filament configurations" refers to configurations where two or more filaments of a multiple filament cathode assembly are operated at a given moment, and the remaining filaments are not operated.

For single filament configurations, the multiple filament cathode assembly may be configured such that any one of the filaments 504, 506, 604 of the multiple filament cathode assembly may be activated. Accordingly, a multiple filament cathode assembly may include a separate single filament configuration for each filament 504, 506, 604. For example, a multiple filament cathode assembly with three filaments may include three different single filament configurations, one to operate each filament independently.

For multiple filament configurations, two or more of the filaments 504, 506, 604 may be operated either in series or parallel ("series configurations" or "parallel configurations"). In a series configuration, two or more of the filaments 504, 506, 604 are connected along a single path, so the same current flows through each of the filaments. In a parallel configuration, two or more of the filaments 504, 506, 604 are connected such that the same voltage is applied to each filament. When multiple filaments are operated in parallel configurations, the voltages placed across the filaments may be the same, but the current travelling through each of the filaments may be different because the properties of the filaments may not be identical. For example, the resistance of the two filaments may be different because of defects or manufacturing tolerances, which may cause a difference in the magnitude of the current flowing through the two filaments. When multiple filaments are operated in series configurations, the magnitude of the current flowing through the filaments is substantially the same.

The different configurations of the multiple filament cathode assembly may require different electrical connection configurations between the generator and the components of the cathode assemblies (i.e., filaments, focusing structure, etc.). In some embodiments, different electrical connection configurations may be implemented by providing a different X-ray tube for each desired configuration. In such embodiments, each X-ray tube includes the requisite electrical connections for a single configuration. However, this may require producing several different X-ray tubes, each having different electrical connections for each of the different configurations of the multiple filament cathode assembly. Producing several different X-ray tubes for different electrical configurations may add complexity to the manufacturing process. Additionally or alternatively, producing several different X-ray tubes for different electrical configurations may increase costs to the customer, and/or may limit a customer's ability to implement different configurations for different applications.

The disclosed embodiments may permit a single X-ray tube with a multiple filament cathode assembly to be driven in different configurations and operational modes, such as series, parallel, or single filament. Accordingly, multiple different X-ray tubes with different electrical configurations may not be required to operate multiple filament cathode assemblies in different configurations.

The disclosed embodiments may include configurations with electrical connections inside of the X-ray tube (or in some configurations, inside of a vacuum envelope of the X-ray tube) that permit the multiple filament cathode assembly to be driven in different configurations (e.g., series, parallel, or single filament) depending on the configuration of the conductive coupler (e.g., cable) that electrically couples a generator to the X-ray tube. Accordingly, the configuration of the multiple filament cathode assembly may be changed between series, parallel, or single filament configurations by simply changing the conductive coupler (e.g., cable) that electrically couples the generator to the X-ray tube. In some circumstances, a dedicated conductive coupler may be provided for each configuration, and one of the conductive couplers may be selected depending on the desired configuration. Accordingly, the electrical connections inside of the X-ray tube (or inside of a vacuum envelope of the X-ray tube) may not need to be changed to operate the multiple filament cathode assembly in different configurations.

Providing a single X-ray tube that may be used in various different configurations may reduce manufacturing costs because multiple different X-ray tubes do not need to be manufactured. Furthermore, the same X-ray tube is used for all configurations and its operational mode is dependent solely on the conductive coupler (cable) that is used. The disclosed embodiments may also reduce costs to customers because they are not required to purchase different X-ray tubes for different configurations. In addition, customers have flexibility in selecting the configuration of an X-ray tube.

Disclosed embodiments may permit selection of a filament to be used by merely switching conductive couplers. For example, one conductive coupler may be used to operate a first filament, a second conductive coupler may be used to operate a second filament, a third conductive coupler may be used to operate a third filament, and so on (depending on the number of filaments included in an X-ray tube). Each of the conductive couplers may include different electrical connections that electrically couples one of the filaments to a generator, thereby providing power to operate the filament. Advantageously, if one of the filaments is no longer operable, the cathode assembly may be configured to operate on one or more remaining filaments, thereby extending the life of the cathode assembly (and X-ray tube).

Furthermore, the disclosed embodiments may be compatible with existing generators. For example, disclosed embodiments may permit existing generators to be coupled to multiple filament cathode assemblies simply by selection of an appropriate conductive coupler for use with a given generator.

Accordingly, the disclosed embodiments may include configurations for electrical connections inside of the X-ray tube (or inside of a vacuum envelope of the X-ray tube).

Additionally or alternatively, the disclosed embodiments may include conductive couplers configured to electrically couple an X-ray tube to a generator (outside of the X-ray tube or outside of the vacuum envelope of the X-ray tube). More particularly, the conductive couplers may be configured to couple a cathode head or a cathode assembly of an X-ray tube to a generator.

Additional details regarding cathode assemblies with multiple filaments are disclosed in U.S. provisional patent application No. 62/451,051, entitled "CATHODE HEAD WITH MULTIPLE FILAMENTS FOR HIGH EMISSION FOCAL SPOT," and patent application Ser. No. 15/717,298 entitled "CATHODE HEAD WITH MULTIPLE FILAMENTS FOR HIGH EMISSION FOCAL SPOT," which are hereby incorporated by reference in their entirety. Any suitable aspects described in the referenced applications may be implemented in the embodiments of the present disclosure.

Figure 4:
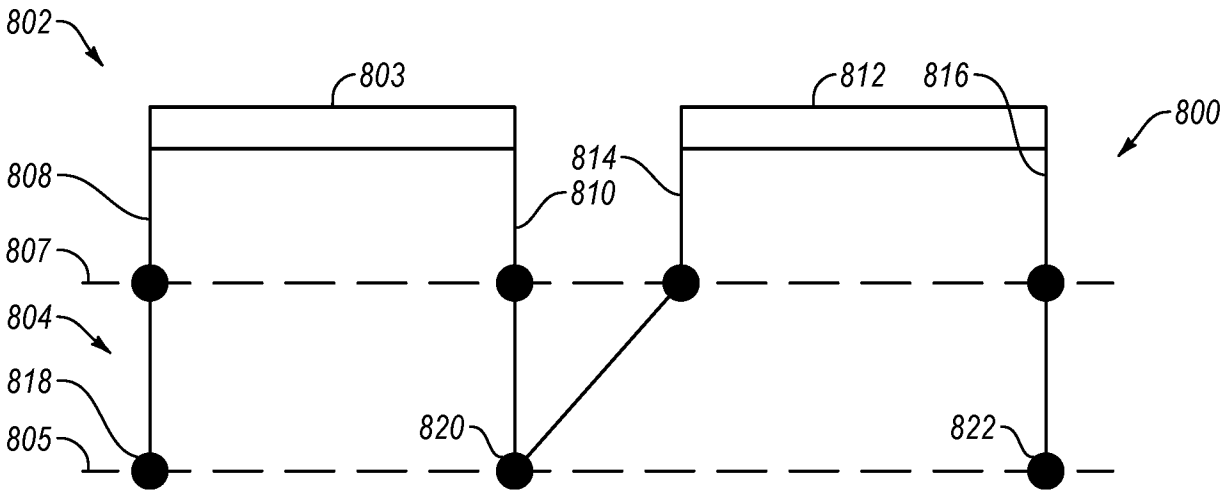
FIG. 4 is a diagram of an example cathode assembly.

As mentioned above, different configurations of multiple filament cathode assemblies may require different electrical connection configurations between the generator and the components of the cathode assemblies (i.e., filaments, focusing structure, etc.). FIG. 4 illustrates an example electrical connection configuration that may permit a single X-ray tube with a multiple filament cathode assembly to be driven in different configurations such as series, parallel, or single filament. In some embodiments, the electrical connection configuration may be positioned within the X-ray tube and/or inside a vacuum envelope of the X-ray tube (see for example, FIG. 1C, and the above description of the vacuum envelope).

FIG. 4 is a diagram of an example cathode assembly 800. The cathode assembly 800 may generally correspond to the cathode assembly 110 of FIGS. 1A-1C and 2, and suitable aspects described herein may be implemented in the X-ray tube 100.

The cathode assembly 800 may include a cathode head 802, which may be represented by the objects above line 807. The cathode head 802 may generally correspond to the cathode head 115 of FIGS. 1C and 2, or the cathode head 600 of FIGS. 3A-3C. The cathode assembly 800 may further include a receptacle 804, which may be represented by the objects above line 805 and below the line 807. The receptacle 804 may generally correspond to a portion of the cathode assembly 110 of FIG. 2, such as one or more of the bottom portion 260, the middle portion 262, and/or the top portion 280.

The cathode head 802 may include an electron emitter 803. The electron emitter 803 may generally correspond to the filament 504 of FIGS. 3A-3C. The electron emitter 803 may include connection location 808 and connection location 810. In some embodiments, the connection location 808 and the connection location 810 may extend from the cathode head 802 such that the connection location 808 and connection location 810 may be connected to a high-voltage source and/or an electrical common. In some configurations, the connection location 808 and the connection location 810 may be connected to a high-voltage source and a low-voltage source (e.g., an electrical common) such that a high voltage difference is created between the connection location 808 and the connection location 810 such that the electron emitter 803 produces electrons by thermionic emission, as described above. As used herein and for simplicity of the illustrations, an electrical common also includes a low-voltage source that is less than the high-voltage source. Operating the electron emitter 803 and other electron emitters described herein to produce electrons may be referred to as "driving" or "running" the electron emitter.

Additionally, the cathode head 802 may include an electron emitter 812. The electron emitter 812 may be generally analogous to the electron emitter 803 and/or may correspond to the filament 506 of FIGS. 3A-3C. The electron emitter 812 may include connection location 814 and connection location 816. The connection location 814 and the connection location 816 may be generally analogous to the connection location 808 and the connection location 810, respectively, of the electron emitter 803. In some configurations, the electron emitter 806 and the electron emitter 812 may be substantially the same size.

In some embodiments, the connection location 814 and the connection location 816 may extend from the cathode head 802 such that the connection location 814 and connection location 816 may be connected to a high-voltage source and/or an electrical common. In some configurations, the connection location 814 and the connection location 816 may be connected to a high-voltage source and an electrical common such that a high voltage difference is created between the connection location 814 and the connection location 816 such that the electron emitter 812 produces electrons by thermionic emission.

In some configurations, the connection locations 808, 810, 814 and/or 816 may be electrical leads. Further, in some configurations the connection locations 808, 810, 814 and/or 816 may be a part of the electron emitters 803, 812. For example, if the electron emitters 803, 812 are coiled filaments, the connection locations 808, 810, 814 and/or 816 may include a non-coiled portion of the electron emitters 803, 812. In some embodiments, the receptacle 804 may include a ceramic receptacle 804. For example, the receptacle 804 may include ceramic for electrical and/or thermal insulation. Additionally or alternatively, the receptacle 804 may be at least partially defined by a housing or a body of the cathode assembly 800.

As used herein, electrically coupled may describe components that are connected in a manner that facilitates electrical communication between the components. In some instances, electrically coupled objects may be connected by conductive materials.

The cathode assembly 800 may include a connector 818 electrically coupled with the connection location 808 of the electron emitter 803. The cathode assembly 800 may include a connector 820 electrically coupled with the connection location 810 of the electron emitter 803 and the connection location 814 of the electron emitter 812. Thus, for example, the connection location 810 and the connection location 814 may be electrically coupled. Although in the illustrated configuration the connection location 810 and the connection location 814 are coupled at the receptacle 804, in other configurations the connection location 810, 814 may be coupled at the cathode head 802 or other positions of the cathode assembly 800.

The cathode assembly 800 may include a connector 822 electrically coupled with the connection location 816 of the electron emitter 812. As illustrated, the connectors 818, 820, and 822 are associated with the receptacle 804. However, in other configurations the connectors 818, 820, and 822 may be positioned at any suitable portion of the cathode assembly 800.

The components of the cathode assembly 800 illustrated in FIG. 4 may generally be included as part of an X-ray tube. For example, the cathode assembly 800 may be included partially or entirely inside of an X-ray tube. In another example, the cathode assembly 800 may be included partially or entirely inside of a vacuum envelope of an X-ray tube. In some configurations, the connectors 818, 820, and/or 822 (e.g., first, second, and third connectors) may be configured to permit components interior of an X-ray tube to be electrically coupled to components exterior of the X-ray tube. As such the connectors 818, 820, and/or 822 may extend from the interior of the X-ray tube to the exterior of the X-ray tube. For example, the connectors 818, 820, and/or 822 may extend from an interior of a body, receptacle, or vacuum envelope of an X-ray tube to an exterior of the body, receptacle, or vacuum envelope. In another example, the connectors 818, 820, and/or 822 may extend from an interior of a cathode assembly of an X-ray tube to an exterior of the cathode assembly of the X-ray tube.

As will be described in further detail below, the configuration of the cathode assembly 800 may permit the multiple electron emitters 803 and 812 to be driven in different configurations such as series, parallel, or single filament. In addition, the configuration of the cathode assembly 800 may permit the multiple electron emitters 803 and 812 to be driven in the different configurations without any modifications to the cathode assembly 800 or the X-ray tube.

Figure 5:
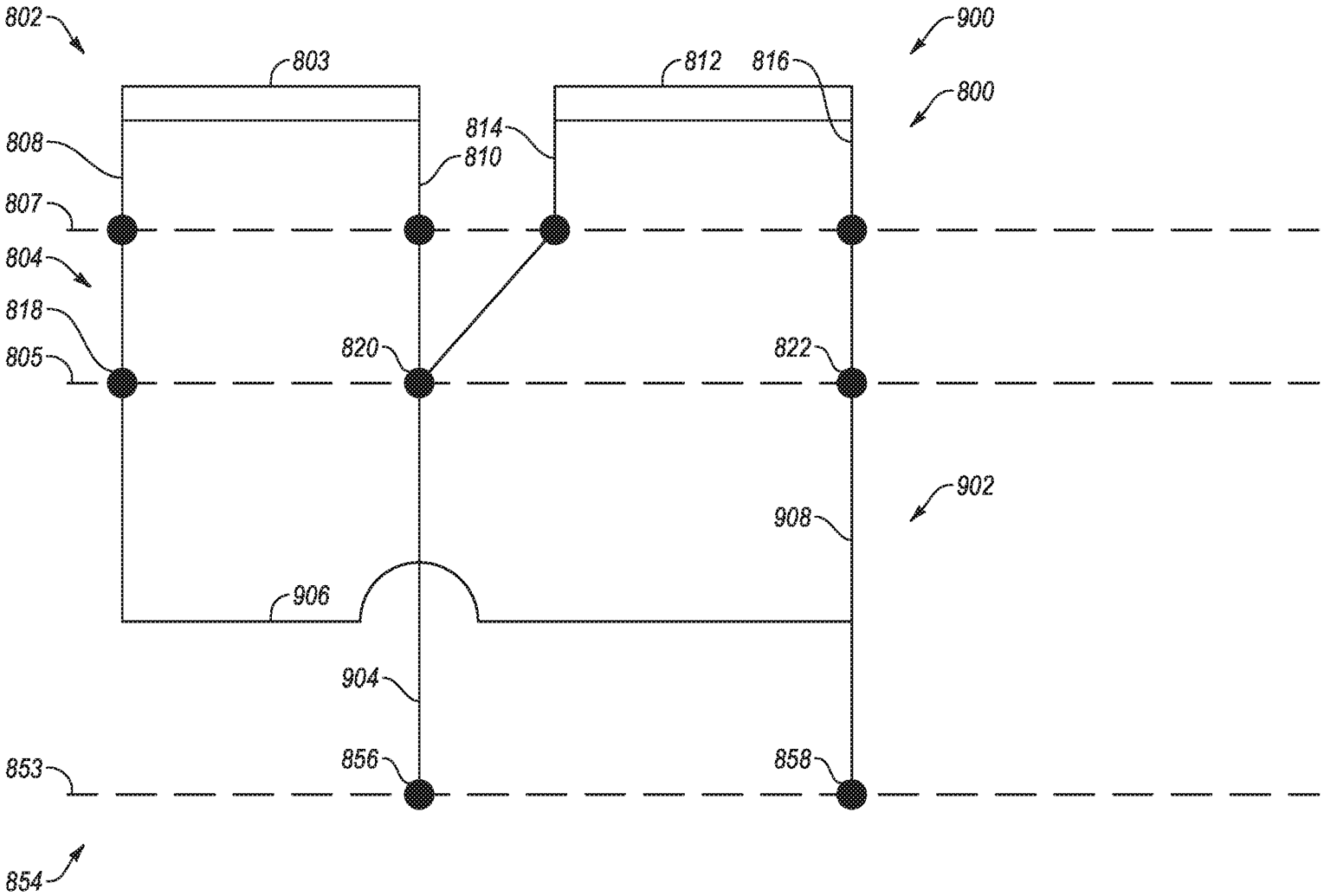
FIG. 5 is a diagram of an example electrical connection configuration for the cathode assembly of FIG. 4.

FIG. 5 is a diagram of an example electrical connection configuration 900 for the cathode assembly 800. As illustrated, the configuration 900 may include the cathode assembly 800, as described with respect to FIG. 4. The configuration 900 may be implemented to operate the electron emitters 803 and 812 of the cathode assembly 800 in parallel (i.e., a parallel configuration).

The configuration 900 may include a generator 854, which may be represented below line 853. The generator 854 may include a first generator connector 856 and a second generator connector 858. In some configurations, the connector 856 may be associated with a high voltage source and the connector 858 may be associated with an electrical common. In particular, the connector 856 may provide a high voltage source and the connector 858 may provide an electrical common, although other configurations may be implemented.

A conductive coupler 902 may extend between the generator 854 and the cathode assembly 800. The conductive coupler 902 may be represented by the objects above line 853 and below the line 805. The conductive coupler 902 may be configured to electrically couple the generator 854 and the cathode assembly 800.

In particular, the conductive coupler 902 may be configured to electrically couple connector 856 of the generator 854 with the connector 820 of the receptacle 804. In addition, the conductive coupler 902 may be configured to electrically couple the connector 858 of the generator 854 with the connectors 818, 822 of the receptacle 804. As illustrated, the conductive coupler 902 includes a first coupler 904, a second coupler 906, and a third coupler 908. The coupler 904 extends between and electrically couples the connector 856 and the connector 820. The coupler 906 extends between and electrically couples the connector 858 and the connector 818. The coupler 908 extends between and electrically couples the connector 858 and the connector 822. As illustrated, in some configurations the coupler 906 may be coupled to the coupler 908. In such configurations, the coupler 906 couples the connectors 818, 858 via the coupler 908, although other suitable configurations may be implemented.

In the illustrated configuration, the high voltage source from the connector 856 may be provided to the connection location 810 and the connection location 814. The electrical common from the connector 858 is electrically coupled to the connection location 808 and the connection location 816. In operation, a high voltage difference is created between the connection location 808 and the connection location 810 such that the electron emitter 803 produces electrons, and a high voltage difference is created between the connection location 814 and the connection location 816 such that the electron emitter 812 produces electrons. As illustrated, the electron emitters 803, 812 are electrically coupled to the generator 854 in a parallel electrical configuration.

Figure 6:
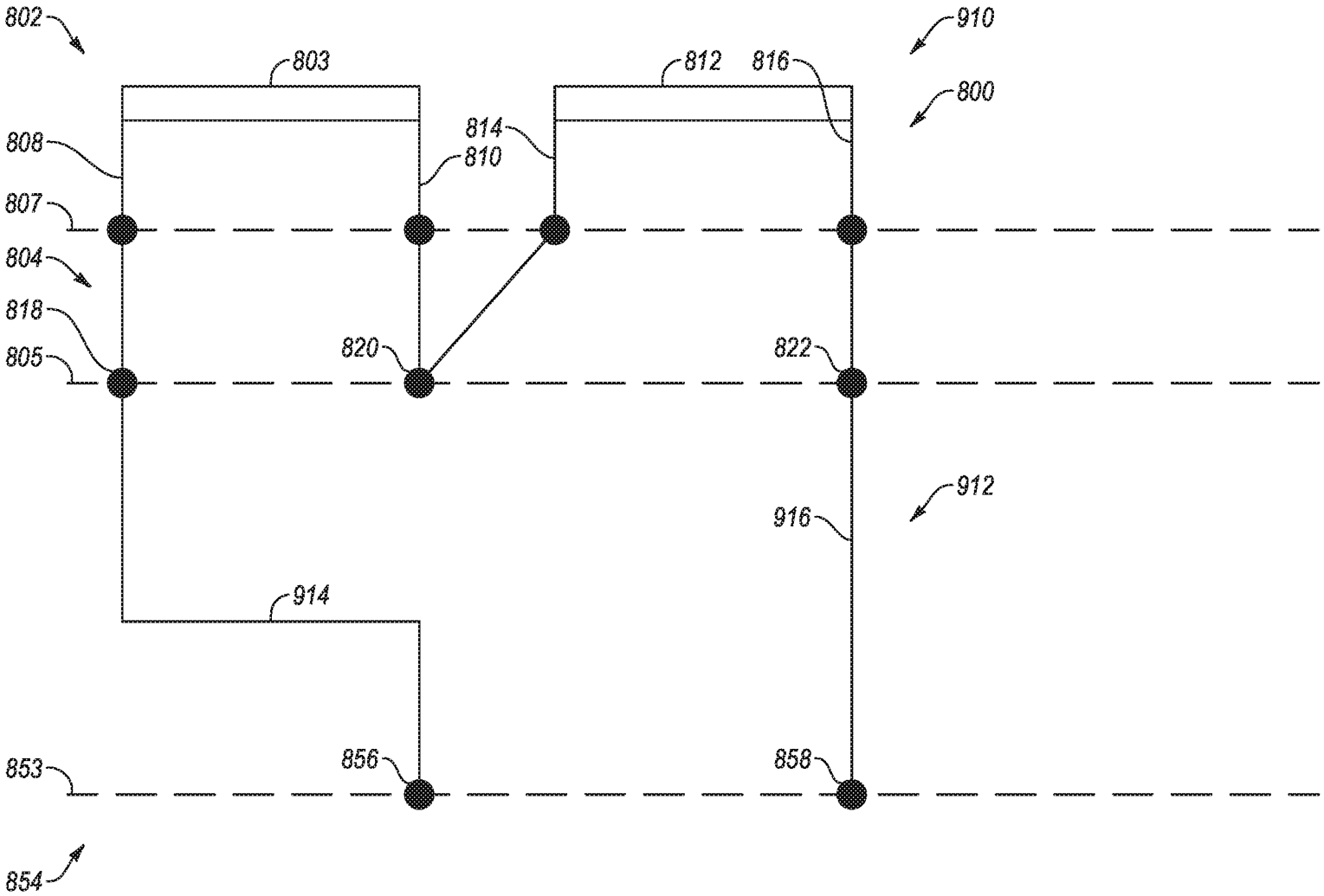
FIG. 6 is a diagram of another example electrical connection configuration for the cathode assembly of FIG. 4.

FIG. 6 is a diagram of an example electrical connection configuration 910 for the cathode assembly 800. As illustrated, the configuration 910 may include the cathode assembly 800 and the generator 854, as described with respect to FIGS. 4 and 5. The configuration 910 may be implemented to operate the electron emitters 803 and 812 of the cathode assembly 800 in series (i.e., a series configuration).

The configuration 910 may include a conductive coupler 912 configured to electrically couple connector 856 with the connector 818. In addition, the conductive coupler 912 may be configured to electrically couple the connector 858 with the connector 822. In the illustrated configuration, the conductive coupler 912 does not directly couple the connector 820 of the receptacle 804 to the generator 854.

As illustrated, the conductive coupler 912 includes a first coupler 914 and a second coupler 916. The coupler 914 extends between and electrically couples the connector 856 and the connector 818. The coupler 916 extends between and electrically couples the connector 858 and the connector 822. The connection location 810 and the connection location 814 are coupled to one another via the connector 820.

In the illustrated configuration, the high voltage source from the connector 856 may be provided to the connection location 808. The electrical common from the connector 858 is electrically coupled to the connection location 816. In operation, a high voltage difference is created between the connection location 808 and the connection location 816. The high voltage difference is created through both of the electron emitters 803, 812, causing the electron emitters 803, 812 to produce electrons. As illustrated, the electron emitters 803, 812 are electrically coupled to the generator 854 in a series electrical configuration. Advantageously, when the electron emitters 803, 812 are operated in series configurations, the current travelling through both electron emitters 803, 812 may be substantially the same.

Figure 7:
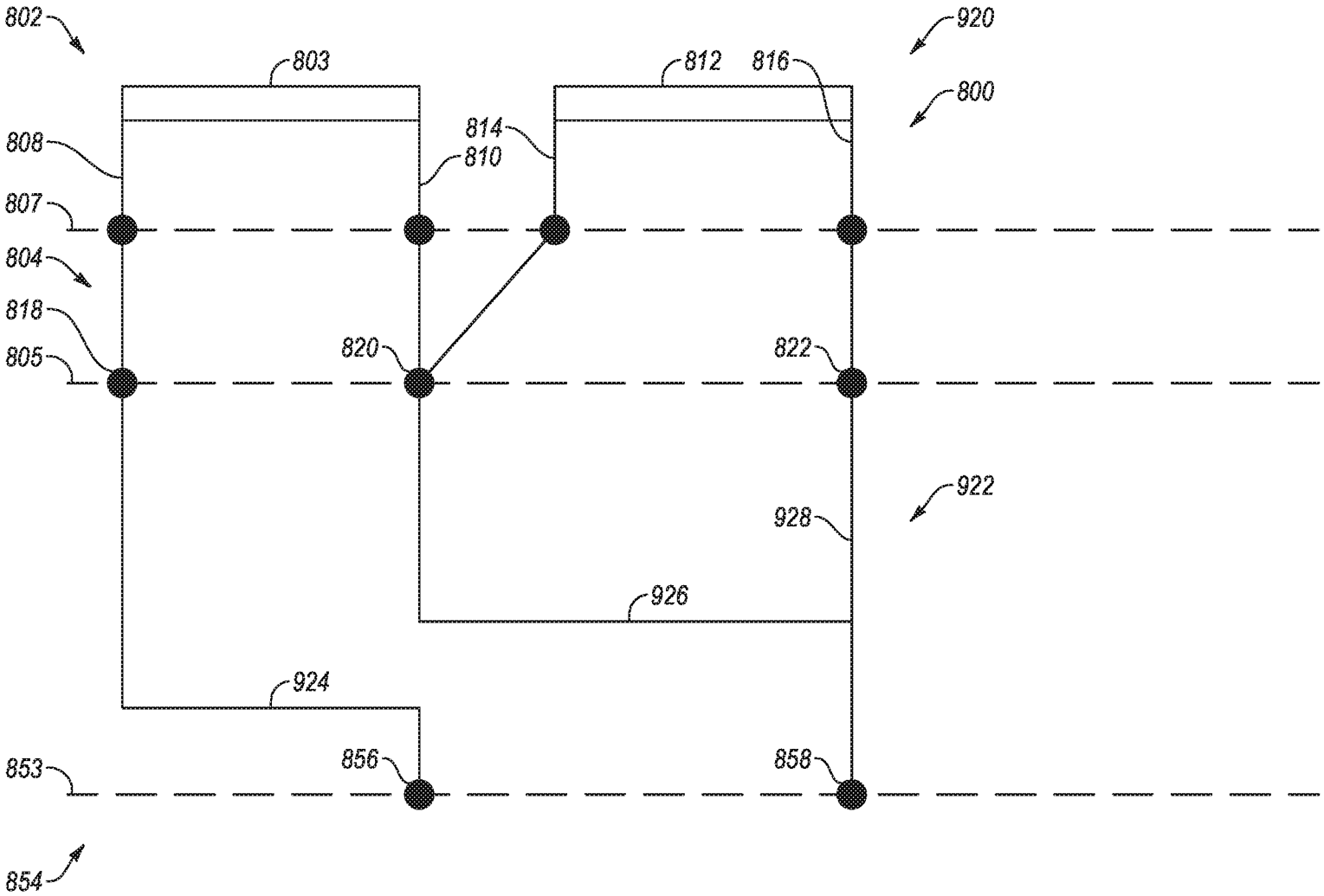
FIG. 7 is a diagram of another example electrical connection configuration for the cathode assembly of FIG. 4.

FIG. 7 is a diagram of an example electrical connection configuration 920 for the cathode assembly 800. As illustrated, the configuration 920 may include the cathode assembly 800 and the generator 854, as described with respect to FIGS. 4 and 5. The configuration 920 may be implemented to operate a single one of the electron emitters 803 and 812, specifically the electron emitter 803 (i.e., a single filament configuration).

The configuration 920 may include a conductive coupler 922 configured to electrically couple connector 856 with the connector 818. In addition, the conductive coupler 922 may be configured to electrically couple the connector 858 with the connectors 820, 822.

As illustrated, the conductive coupler 922 includes a first coupler 924, a second coupler 926, and a third coupler 928. The coupler 924 extends between and electrically couples the connector 856 and the connector 818. The coupler 926 extends between and electrically couples the connector 858 and the connector 820. The coupler 928 extends between and electrically couples the connector 858 and the connector 822. As illustrated, in some configurations the coupler 926 may be coupled to the coupler 928. In such configurations, the coupler 926 couples the connectors 820, 858 via the coupler 928, although other suitable configurations may be implemented.

In the illustrated configuration, the high voltage source from the connector 856 of the generator 854 may be provided to the connection location 808. The electrical common from the connector 858 is electrically coupled to the connection location 810 and both connection locations 814, 816. In such configurations, the electron emitter 812 is shorted. In operation, a high voltage difference is created between the connection locations 808, 810 such that the electron emitter 803 produces electrons. However, the electron emitter 812 is shorted and does not operate.

Although as illustrated the electron emitter 812 is shorted and the electron emitter 803 operates, other configurations may be implemented such that the electron emitter 803 does not operate and the electron emitter 812 operates.

Figure 8:
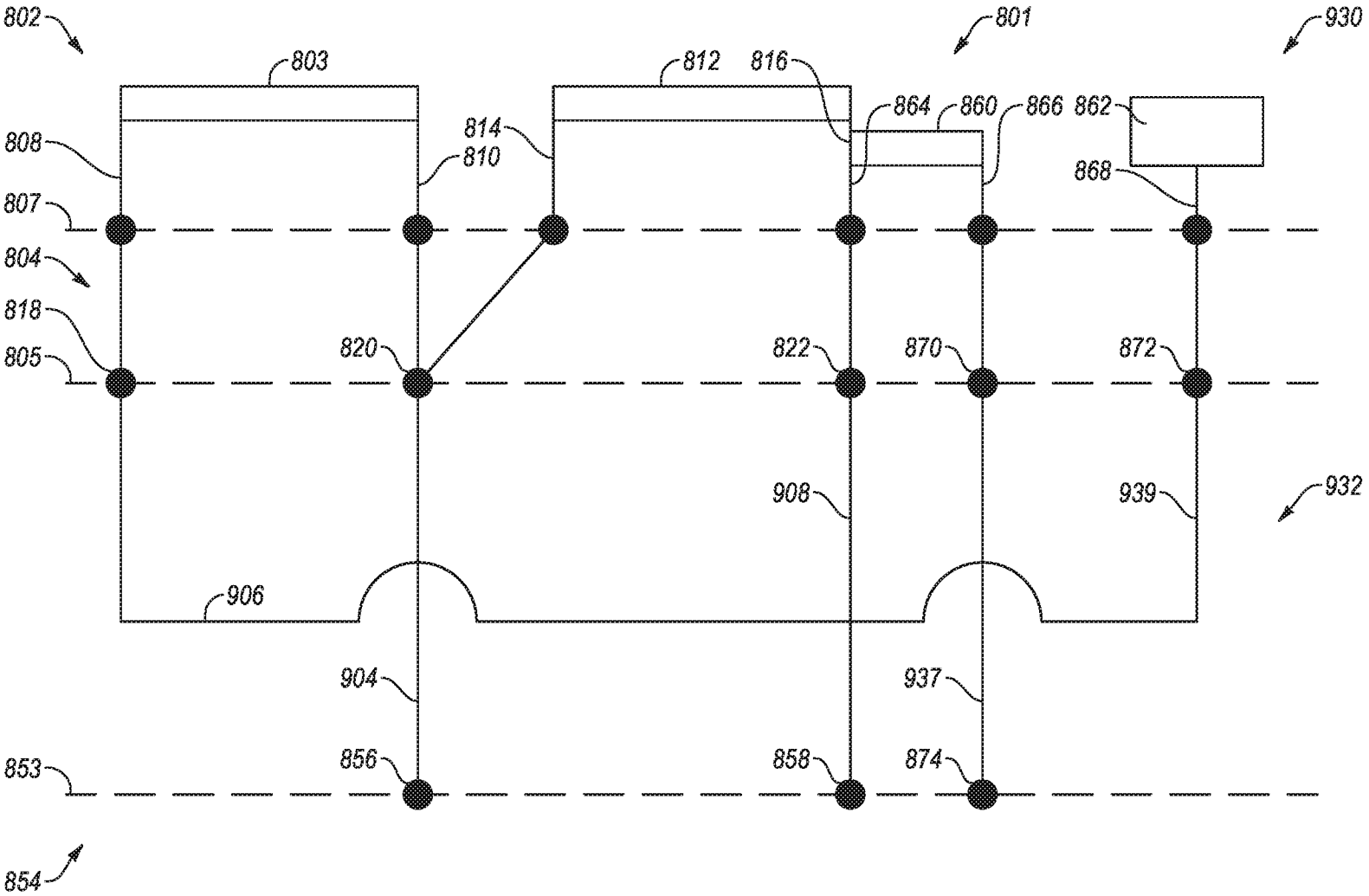
FIG. 8 is a diagram of another example electrical connection configuration for a cathode assembly.

FIG. 8 is a diagram of an example electrical connection configuration 930 for a cathode assembly 801. The cathode assembly 801 includes the aspects described above with respect to the cathode assembly 800. In addition, the cathode assembly 801 includes a third emitter 860 and a focusing structure 862 positioned on the cathode head 802.

The electron emitter 860 may be generally analogous to the electron emitters 803, 812 and/or may correspond to the filament 604 of FIGS. 3A-3C. The electron emitter 860 may include a connection location 864 and a connection location 866. As illustrated, the connection location 864 is proximate or in substantially the same position as the connection location 816. In some configurations, the electron emitter 812 and the electron emitter 860 may share a connection location. In other configurations, the connection location 816 of the electron emitter 812 may be electrically coupled with the connection location 864 of the electron emitter 860.

As illustrated, the electron emitters 803 and 812 may be substantially the same size, while the electron emitter 860 is smaller than the electron emitters 803, 812, although other configurations may be implemented. The electron emitter 860 may include at least one dimension smaller than the electron emitter 803 and/or the electron emitter 812. For example, the electron emitter 860 may include an overall length, coil length, filament diameter, coil diameter, or other dimension that is smaller than a corresponding dimension of the electron emitter 803 and/or the electron emitter 812.

The focusing structure 862 may be generally analogous to the focusing structure having the focusing grid 620 and/or the focusing grid as described with respect to FIGS. 3A-3C. In some configurations, the focusing structure 862 may include a focusing grid at least partially surrounding one or more of the electron emitter 803, 812, 860 and configured to steer and/or focus electron beams emitted by the electron emitter 803, 812, 860 by imposing electrical fields and/or spatial limitations on the electron beams. In some configurations, the focusing grid may be implemented to steer and/or focus electron beams emitted by all three of the electron emitter 803, 812, 860, although other configurations may be implemented. The focusing structure 862 may include connection location 868.

The cathode assembly 801 may include a connector 870 (e.g., a fourth connector) electrically coupled with the connection location 866. The connector 822 of the cathode assembly 801 may be electrically coupled with the connection location 864. The cathode assembly 801 may include a connector 872 electrically coupled with the connection location 868 of the focusing structure 862. Although in the illustrated configuration the connection location 816 and the connection location 864 are coupled at the cathode head 802, in other configurations the connection location 816, 864 may be coupled at the receptacle 804 or other positions. As illustrated, the connectors 870, 872 are associated with the receptacle 804. However, in other configurations the connectors 870, 872 may be positioned at any suitable portion of the cathode assembly 801.

The components of the cathode assembly 801 illustrated in FIG. 8 may generally be included as part of an X-ray tube. For example, the cathode assembly 801 may be included partially or entirely inside of an X-ray tube. In another example, the cathode assembly 801 may be included partially or entirely inside of a vacuum envelope of an X-ray tube.

In some configurations, the connection locations 864, 866 and/or 868 may be electrical leads. Further, in some configurations the connection locations 864 and/or 866 may be a part of the electron emitter 860. For example, if the electron emitter 860 is a coiled filament, the connection locations 864 and/or 866 may include a non-coiled portion of the electron emitter 860. In some configurations, the electron emitter 812 and the electron emitter 860 may share at least a portion of their respective electrical leads. In other configurations, the electrical leads of the electron emitters 812, 860 may be coupled to one another.

In some configurations, the connectors 870 and/or 872 may be configured to permit components interior of an X-ray tube to be electrically coupled to components exterior of the X-ray tube. As such the connectors 870 and/or 872 may extend from the interior of the X-ray tube to the exterior of the X-ray tube. For example, the connectors 870 and/or 872 may extend from an interior of a body, receptacle, or vacuum envelope of an X-ray tube to an exterior of the body, receptacle, or vacuum envelope. In another example, the connectors 870 and/or 872 may extend from an interior of a cathode assembly of an X-ray tube to an exterior of the cathode assembly of the X-ray tube.

The configuration 930 generally includes the features described above with respect to the configuration 900 of FIG. 5. In addition, the configuration 930 includes components associated with the third emitter 860 and the focusing structure 862. The configuration 930 includes the generator 854 as described above. In addition, the generator 854 may include a third generator connector 874. In some configurations, the connector 874 may be associated with a second high voltage source. In particular, the connector 874 may provide a high voltage source configured to drive the filament 860. In some configurations, the voltage provided to the connector 874 may be different than the voltage provided to the connector 856.

A conductive coupler 932 may be configured to electrically couple connector 856 with the connector 820. In addition, the conductive coupler 932 may be configured to electrically couple the connector 858 with the connectors 818, 822, and 872. Further, the conductive coupler 932 may be configured to electrically couple the connector 874 of the generator 854 with the connector 870 of the receptacle 804.

As illustrated, the conductive coupler 932 includes a first coupler 904, a second coupler 908, a third coupler 937, a fourth coupler 906, and a fifth coupler 939. The coupler 904 extends between and electrically couples the connector 856 and the connector 820. The coupler 908 extends between and electrically couples the connector 858 and the connector 822. The coupler 937 extends between and electrically couples the connector 874 and the connector 870. The coupler 906 extends between and electrically couples the connector 818 and the connector 858 via the coupler 908.

The coupler 939 extends between and electrically couples the connector 872 and the connector 858 via the coupler 908.

In the illustrated configuration, the high voltage source from the connector 856 may be provided to the connection location 810 and the connection location 814. The high voltage source from the connector 874 may be provided to the connection location 866. The electrical common from the connector 858 is electrically coupled to the connection location 808, the connection location 816, the connection location 864, and the connection location 868.

In operation, a high voltage difference is created between the connection location 808 and the connection location 810 such that the electron emitter 803 produces electrons. A high voltage difference is created between the connection location 814 and the connection location 816 such that the electron emitter 812 produces electrons. A high voltage difference is created between the connection location 866 and the connection location 864 such that the electron emitter 860 produces electrons. The focusing structure 862 is electrically coupled to the electrical common and therefore does not operate. As illustrated, the electron emitters 803, 812 are electrically coupled to the generator 854 in a parallel electrical configuration.

In some configurations, the generator 854 may be configured to operate the electron emitter 860 a different time than the electron emitters 803, 812. For example, the generator 854 may be configured to supply a voltage to the connector 856 at a different time than it supplies a voltage to the connector 874. In other configurations, the generator 854 may operate all three electron emitters 803, 812, 860 simultaneously.

Figure 9:
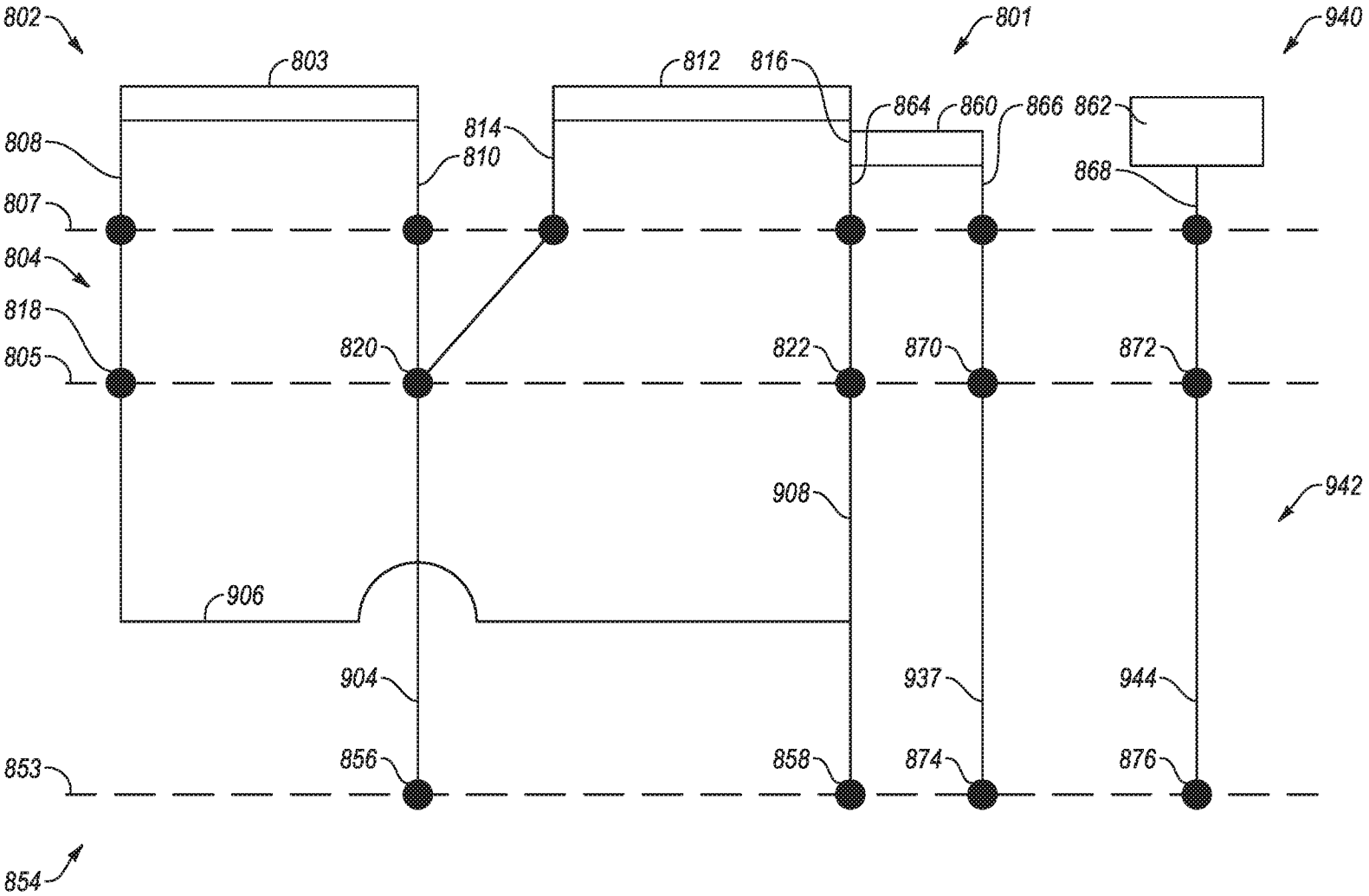
FIG. 9 is a diagram of another example electrical connection configuration for the cathode assembly of FIG. 8.

FIG. 9 is a diagram of an example electrical connection configuration 940 for the cathode assembly 801. As illustrated, the configuration 940 includes the features described above with respect to the configuration 930 of FIG. 8. However, the configuration 940 is configured to operate the focusing structure 862 in addition to the electron emitters 803, 812, 860. Accordingly, the configuration 940 includes a conductive coupler 942 configured to operate the focusing structure 862 as well as the electron emitters 803, 812, 860. In this configuration, the generator 854 includes a fourth generator connector 876. The connector 876 may be configured to supply a grid voltage such that the focusing structure 862 focuses and/or steers one or more electron beams from the electron emitters 803, 812, 860.

The conductive coupler 942 includes the couplers 904, 908, 937, 906 as described above with respect to the conductive coupler 932 of FIG. 8. However, instead of the coupler 939, the conductive coupler 942 includes coupler 944, which extends between and electrically couples the connector 876 and the connector 872. Accordingly, the conductive coupler 942 is configured to electrically couple connector 876 with the connector 872.

The configuration 940 operates the electron emitters 803, 812, 860 as described above with respect to the configuration 930. In addition, the configuration 940 operates the focusing structure 862 by providing voltage from the connector 876 to the connection location 866.

Figure 10:
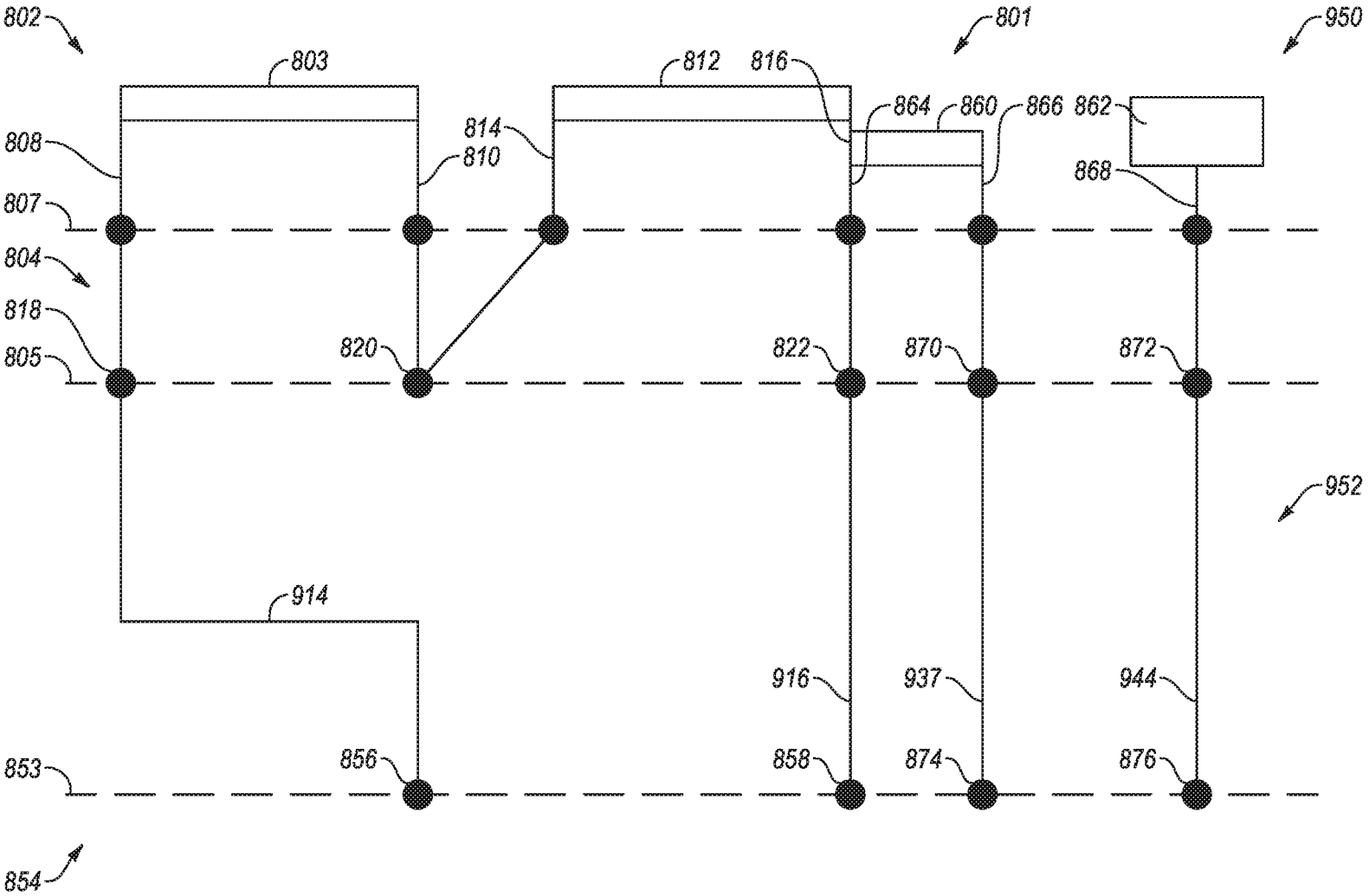
FIG. 10 is a diagram of another example electrical connection configuration for the cathode assembly of FIG. 8.

FIG. 10 is a diagram of an example electrical connection configuration 950 for the cathode assembly 801. As illustrated, the configuration 950 includes the features described above with respect to the configuration 940 of FIG. 9. However, the configuration 950 includes a conductive coupler 952 that operates the electron emitters 803 and 812 in series rather than parallel.

In particular, the conductive coupler 952 is configured to electrically couple connector 856 with the connector 818. In addition, the conductive coupler 952 is configured to electrically couple the connector 858 with the connector 822. In the illustrated configuration, the conductive coupler 952 does not directly couple the connector 820 of the receptacle 804 to the generator 854. The conductive coupler 952 is also configured to electrically couple the connector 874 with the connector 870. The conductive coupler 952 is also configured to electrically couple the connector 876 with the connector 872.

As illustrated, the conductive coupler 952 includes a first coupler 914, a second coupler 916, a third coupler 937, and a fourth coupler 944. The coupler 914 extends between and electrically couples the connector 856 and the connector 818. The coupler 916 extends between and electrically couples the connector 858 and the connector 822. The coupler 937 extends between and electrically couples the connector 874 and the connector 870. The coupler 944 extends between and electrically couples the connector 876 and the connector 872. The connection location 810 and the connection location 814 are coupled to one another via the connector 820.

In operation, the electron emitters 803 and 812 are operated in series, as described with respect to FIG. 6. The electron emitter 860 operates as described above in FIG. 8, and the focusing structure 862 operates as described in FIG. 9. In other configurations, the focusing structure 862 may be disabled by coupling the focusing structure 862 to the electrical common of the generator 854, as illustrated in FIG. 8.

Figure 11:
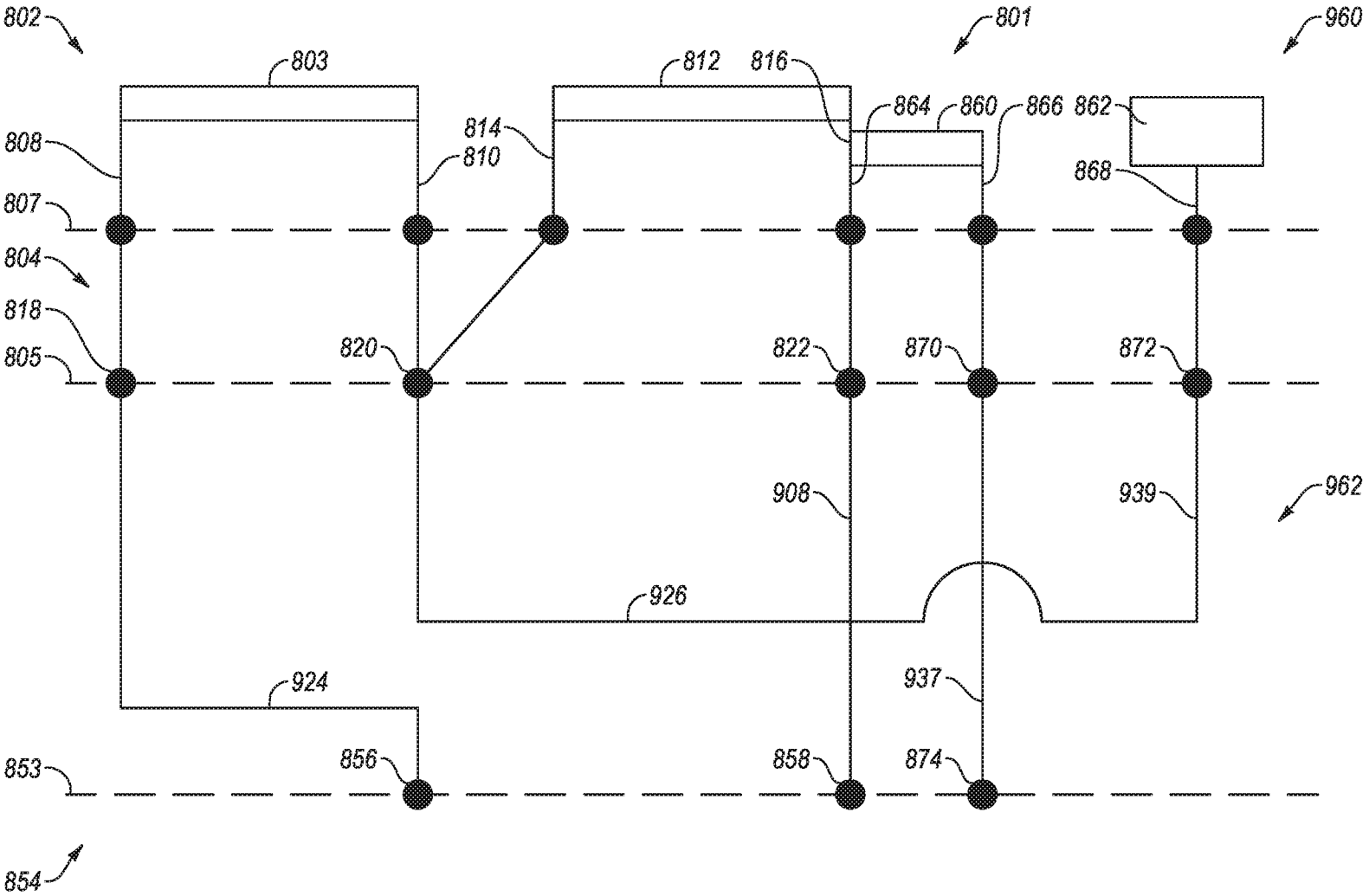
FIG. 11 is a diagram of another example electrical connection configuration for the cathode assembly of FIG. 8.

FIG. 11 is a diagram of an example electrical connection configuration 960 for the cathode assembly 801. As illustrated, the configuration 960 includes the features described above with respect to the configuration 950 of FIG. 9. However, the configuration 960 includes a conductive coupler 962 that operates the electron emitter 803 and the electron emitter 860, but not the electron emitter 812. In addition, in the configuration 960 the focusing structure 862 is not operated. Accordingly, in the illustrated configuration, the fourth generator connector 876 is not shown because it may not be included in the generator 854.

In particular, the conductive coupler 962 is configured to electrically couple connector 856 with the connector 818. In addition, the conductive coupler 962 is configured to electrically couple the connector 858 with the connectors 820, 822, 872. Further, the conductive coupler 962 is configured to electrically couple the connector 874 with the connector 870.

As illustrated, the conductive coupler 962 includes a first coupler 924, a second coupler 926, a third coupler 939, and fourth coupler 908, and a fifth coupler 937. The coupler 924 extends between and electrically couples the connector 856 and the connector 818. The coupler 908 extends between and electrically couples the connector 858 and the connector 822. The coupler 926 extends between and electrically couples the connector 858 and the connector 820 via the coupler 908. The coupler 939 extends between and electrically couples the connector 858 and the connector 872 via the coupler 908. The coupler 937 extends between and electrically couples the connector 874 and the connector 870.

In the illustrated configuration, the electron emitter 812 is shorted (because it is coupled to the electrical common on both sides) and the electron emitter 803 operates similar to FIG. 7. The electron emitter 860 operates as described with respect to FIG. 8. The focusing structure 862 is electrically coupled to the electrical common and therefore does not operate, as described with respect to FIG. 8. In some configurations, the generator 854 may be configured to operate the electron emitter 860 a different time than the electron emitter 803. For example, the generator 854 may be configured to supply a voltage to the connector 856 at a different time than it supplies a voltage to the connector 874. In other configurations, the generator 854 may operate the electron emitters 803, 860 simultaneously. Although the focusing structure 862 is not activated in the configuration 960, the focusing structure 862 may be enabled by electrically coupling it to the generator 856 in a manner that supplies a grid voltage, as shown in FIG. 10.

In some configurations, the conductive couplers 902, 912, 922, 932, 942, 952 may be implemented as one or more electrical cables or cords extending between the generator 856 and the cathode assemblies 800, 801. For example, the conductive couplers may be high voltage cables designed to handle the voltage necessary to operate the X-ray tube. In one example, the high voltage cables can provide a high voltage difference of at least 1 kilovolt (kV). In another example, the high voltage cables can provide a high voltage difference of at least 10 kV. In these and other embodiments, the ends of the high voltage cables may include connection structures that align the conductive couplers with the configurations of the connectors of the receptacle 804 and the generator 854. In other configurations, the conductive couplers may be any couplers suitable for coupling the generator 856 and the cathode assemblies 800, 801 as described herein.

In some configurations, the objects above line 805 in FIGS. 4-11 may generally be included as part of an X-ray tube. For example, the cathode assemblies 800, 801 may be included partially or entirely inside of an X-ray tube. In another example, the cathode assemblies 800, 801 may be included partially or entirely inside of a vacuum envelope of an X-ray tube. Further, the objects below line 805 in FIGS. 4-11 may be outside of an X-ray tube. For example, the generator 854 and the conductive couplers 902, 912, 922, 932, 942, 952 may be outside of an X-ray tube. In another example, the generator 854 and the conductive couplers 902, 912, 922, 932, 942, 952 may be included outside of a vacuum envelope of an X-ray tube. In other configurations, the conductive couplers 902, 912, 922, 932, 942, 952 may extend into an X-ray tube or a vacuum envelope.

In some embodiments, an X-ray imaging system may include a cathode head or cathode assembly with a first electron emitter, a second electron emitter, and/or a third electron emitter. The first electron emitter may include a first connection location and a second connection location. The second electron emitter may include a third connection location and a fourth connection location. The third connection location may be electrically coupled with the second connection location of the first electron emitter. In some embodiments, the first electron emitter and the second electron emitter may have substantially the same size. The third electron emitter may include a fifth connection location and a sixth connection location. In some embodiments, the third electron emitter may include at least one dimension smaller than a corresponding dimension of the first electron emitter or the second electron emitter. The X-ray imaging system may include a focusing structure.

The cathode assembly may include a first cathode connector electrically coupled with the first connection location of the first electron emitter. The cathode assembly may include a second cathode connector electrically coupled with the second connection location of the first electron emitter and the third connection location of the second electron emitter. The cathode assembly may include a third cathode connector electrically coupled with the fourth connection location of the second electron emitter and the fifth connection location of the third electron emitter. The cathode assembly may include a fourth cathode connector electrically coupled with the sixth connection location of the third electron emitter. The cathode assembly may include a fifth cathode connector electrically coupled with the focusing structure.

The X-ray imaging system may include a generator having a first generator connector, a second generator, and a third generator connector. The first generator connector may be electrically coupled with a first electrical supply. The second generator connector may be electrically coupled with an electrical common. The third generator connector may be electrically coupled with a second electrical supply.

The X-ray imaging system may include a conductive coupler configured to electrically couple the first, second, third, and fourth cathode connectors with the first, second, and third generator connectors. Based on the configuration of the conductive coupler, the third electron emitter may be configured to operate and at least one of the following: the first electron emitter and the second electron emitter may be configured to operate in parallel, the first electron emitter and the second electron emitter may be configured to operate in series, the first electron emitter may be configured to operate and the second electron emitter is not configured to operate, and the first electron emitter may be configured not to operate and the second electron emitter may be configured to operate.

In some configurations, the generator further may include a fourth generator connector electrically coupled with a third electrical supply; and the conductive coupler may be further configured to electrically couple the fifth cathode connector with at least one of: the second generator connector and the fourth generator connector.

In one example embodiment, a cathode assembly (110, 800) for an X-ray tube (100) may include a cathode head (115, 600). The cathode head (115, 600) may include a first electron emitter (504, 803) having a first connection location (808) and a second connection location (810), and a second electron emitter (506, 812) having a third connection location (814) and a fourth connection location (816). The third connection location (814) may be electrically coupled with the second connection location (810) of the first electron emitter (504, 803). A first connector (818) may be electrically coupled with the first connection location (808) of the first electron emitter (504, 803). A second connector (820) may be electrically coupled with the second connection location (810) of the first electron emitter (504, 803) and the third connection location (814) of the second electron emitter (506, 812). A third connector (822) may be electrically coupled with the fourth connection location (816) of the second electron emitter (506, 812).

In some configurations, the first electron emitter (504, 803) and the second electron emitter (506, 812) may be configured to operate in parallel when an electrical supply may be may be electrically coupled with the second connector (820) and an electrical common may be electrically coupled with the first connector (818) and the third connector (822). The first electron emitter (504, 803) and the second electron emitter (506, 812) may be configured to operate in series when the electrical supply may be electrically coupled with the first connector (818) and the electrical common may be electrically coupled with the third connector (822). In some aspects, the first electron emitter (504, 803) and the second electron emitter (506, 812) may be substantially the same size.

In some configurations, the cathode assembly (110, 800) further may include a third electron emitter (604, 860) having a fifth connection location (864) and a sixth connection location (866). The fifth connection location (864) may be electrically coupled with the fourth connection location (816) of the second electron emitter (506, 812) and the third connector (822) of the cathode assembly (110, 800). A fourth connector (870) may be electrically coupled with the fifth connection location (864) of the third electron emitter (604, 860).

The first electron emitter (504, 803) and the second electron emitter (506, 812) may be the same size and the third electron emitter (604, 860) may include a least one dimension smaller than a corresponding dimension of the first electron emitter (504, 803) and the second electron emitter (506, 812). The third connector (822) may be electrically coupled with an electrical common and the fourth connector (870) may be electrically coupled with an electrical supply.

The first electron emitter (504, 803) and the second electron emitter (506, 812) may be configured to operate in parallel when a first electrical supply is electrically coupled with the second connector (820), an electrical common is electrically coupled with the first connector (818) and the third connector (822), and a second electrical supply may be electrically coupled with the fourth connector (870). The first electron emitter (504, 803) and the second electron emitter (506, 812) may be configured to operate in series when the first electrical supply is electrically coupled with the first connector (818), the electrical common is electrically coupled with the third connector (822), and the second electrical supply is electrically coupled with the fourth connector (870).

The cathode head (115, 600) may further include a focusing structure (862). A fourth connector (868) may be electrically coupled with the focusing structure (862), and an electrical supply may be electrically coupled with the fourth connector (870).

In another example embodiment, an X-ray imaging system may include a cathode assembly (110, 800). The cathode assembly (110, 800) may include a first electron emitter (504, 803) having a first connection location (808) and a second connection location (810); and a second electron emitter (506, 812) having a third connection location (814) and a fourth connection location (816). The third connection location (814) may be electrically coupled with the second connection location (810) of the first electron emitter (504, 803). A first cathode connector (818) may be electrically coupled with the first connection location (808) of the first electron emitter (504, 803).

A second cathode connector (820) may be electrically coupled with the second connection location (810) of the first electron emitter (504, 803) and the third connection location (814) of the second electron emitter (506, 812). A third cathode connector (822) may be electrically coupled with the fourth connection location (816) of the second electron emitter (506, 812).

In some aspects, the X-ray imaging system further may include a generator (854). The generator (854) may include a first generator connector (856) that may be electrically coupled with a first electrical supply, and a second generator connector (858) that may be electrically coupled with a second electrical supply.

A conductive coupler may electrically couple a first generator connector (856) of a generator (854) with the second cathode connector (820) and may electrically couple a second generator connector (858) of the generator (854) with the first cathode connector (818) and the third cathode connector (822).

A conductive coupler that may electrically couple a first generator connector (856) of a generator (854) with the first cathode connector (818) and may electrically couple a second generator connector (858) of the generator (854) with the third cathode connector (822).

In some aspects, cathode assembly (110, 800) further may include a third electron emitter (604, 860) having a fifth connection location (864) and a sixth connection location (866), the fifth connection location (864) may be electrically coupled with the fourth connection location (816) of the second electron emitter (506, 812) and the third cathode connector (822). A fourth cathode connector may be electrically coupled with the sixth connection location (866) of the third electron emitter (604, 860).

In some aspects, a conductive coupler may electrically couple a first generator connector (856) of a generator (854) with the second cathode connector (820), and may electrically couple a second generator connector (858) of the generator (854) with the first cathode connector (818) and the third cathode connector (822), and may electrically couple a third generator connector of the generator (854) with the fourth cathode connector.

In another aspect, a conductive coupler may electrically couple a first generator connector (856) of a generator (854) with the first cathode connector (818), may electrically couple a second generator connector (858) of the generator (854) with the third cathode connector (822), and may electrically couple a third generator connector of the generator (854) with the fourth cathode connector.

In yet another aspect, a conductive coupler that may electrically couple a first generator connector (856) of a generator (854) with the first cathode connector (818), may electrically couple a second generator connector (858) of the generator (854) with the second cathode connector (820) and the third cathode connector (822), and may electrically couple a third generator connector (874) of the generator (854) with the fourth cathode connector (870).

In some aspects, the cathode assembly (110, 800) may include a focusing structure (862) and a fifth cathode connector (872) may be electrically coupled with the focusing structure (862).

In some aspects, the X-ray imaging system may further may include a generator (854). The generator (854) may include a first generator connector (856) that may be electrically coupled with a first electrical supply, a second generator connector (858) that may be electrically coupled with an electrical common, a third generator connector (874) that may be electrically coupled with a second electrical supply, and a fourth generator connector (876) that may be electrically coupled with a third electrical supply. A first conductive coupler may be configured to electrically couple the first generator connector (856) with the first cathode connector, to electrically couple the second generator connector (858) with the third cathode connector (822), to electrically couple the third generator connector (874) with the fourth cathode connector (870), and to electrically couple the fourth generator connector (876) with the fifth cathode connector (872). A second conductive coupler may be configured to electrically couple the first generator connector (856) with the second cathode connector (820), to electrically couple the second generator connector (858) with the first cathode connector (818) and the third cathode connector (822), to electrically couple the third generator connector (874) with the fourth cathode connector (870), and to electrically couple the fourth generator connector with the fifth cathode connector.

In another example embodiment, a conductive coupler may be configured to electrically couple a generator (854) with an X-ray tube (100), the conductive coupler may include a first coupler and a second coupler. The first coupler may be configured to electrically couple a first generator connector (856) of the generator (854) with a first electron emitter (504, 803) of the X-ray tube (100), wherein the generator (854) may be configured to provide a high-voltage source at the first generator connector (856). The second coupler may be configured to electrically couple a second generator connector (858) of the generator (854) with a second electron emitter (506, 812) of the X-ray tube (100), wherein the generator (854) may be configured to provide an electrical common at the second generator connector (858). The conductive coupler may be configured to simultaneously operate the first electron emitter (504, 803) and the second electron emitter (506, 812), and the conductive coupler may be configured to extend between and be removably coupled to the generator (854) and the X-ray tube (100).

In some aspects, a third coupler may be configured to electrically couple the second generator connector (858) of the generator (854) with the first electron emitter (504, 803). The third coupler may be configured to electrically couple a first connector (818) of the first electron emitter (504, 803) with the second generator connector (858). The first coupler may be configured to electrically couple a second connector (820) of the first electron emitter (504, 803) and a third connector (822) of the second electron emitter (506, 812) with the first generator connector (856). The second coupler may be configured to electrically couple a fourth connector (870) of the second electron emitter (506, 812) with the second generator connector (858).

In further aspects, the first coupler may be configured to electrically couple a first connector (818) of the first electron emitter (504, 803) with the first generator connector (856). A second connector (820) of the first electron emitter (504, 803) may be electrically coupled to a third connector (822) of the second electron emitter (506, 812). The second coupler may be configured to electrically couple a fourth connector (870) of the second electron emitter (506, 812) with the second generator connector (858).

In some aspects, a third coupler may be configured to electrically couple the second generator connector (858) of the generator (854) with the first electron emitter (504, 803) and the second electron emitter (506, 812). The first coupler may be configured to electrically couple a first connector (818) of the first electron emitter (504, 803) with the first generator connector (856). The second coupler may be configured to electrically couple a second connector (820) of the first electron emitter (504, 803) and a third connector (822) of the second electron emitter (506, 812) with the second generator connector (858). The third coupler may be configured to electrically couple a fourth connector (870) of the second electron emitter (506, 812) with the second generator connector (858).

In some aspects, the second coupler may be configured to electrically couple the second generator connector (858) with a third electron emitter (604, 860) of the X-ray tube (100). The second coupler may be configured to electrically couple the second generator connector (858) with a fifth connector (864) of the third electron emitter (604, 860). A third coupler may be configured to electrically couple a sixth connector (866) of the third electron emitter (604, 860) with a third generator connector (874). The generator (854) may be configured to provide a second high-voltage source at the third generator connector (874).

In further aspects, a third coupler may be configured to electrically couple a focusing structure (862) of the X-ray tube (100) with a third generator connector (876), wherein the generator (854) may be configured to provide a grid voltage at the third generator connector (876). The conductive coupler may include a third coupler configured to electrically couple a focusing structure (862) of the X-ray tube (100) with the second generator connector (876). The conductive coupler may be configured to operate the first electron emitter (504, 803) and the second electron emitter (506, 812) in parallel or in series.

The terms and words used in the following description and claims are not limited to the bibliographical meanings, but, are merely used to enable a clear and consistent understanding of the disclosure. It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

Aspects of the present disclosure may be embodied in other forms without departing from its spirit or essential characteristics. The described aspects are to be considered in all respects illustrative and not restrictive. The claimed subject matter is indicated by the appended claims rather than by the foregoing description. All changes which come within the meaning and range of equivalency of the claims are to be embraced within their scope.

What is claimed is:

1. An X-ray imaging system comprising:

a cathode head within a vacuum envelope of an X-ray tube, the cathode head comprising:

a first electron emitter having a first connection location and a second connection location; and a second electron emitter having a third connection location and a fourth connection location; and a receptacle of the X-ray tube comprising:

a first cathode connector electrically coupled with the first connection location of the first electron emitter;

a second cathode connector electrically coupled with the second connection location of the first electron emitter and the third connection location of the second electron emitter; and a third cathode connector electrically coupled with the fourth connection location of the second electron emitter;

wherein the first, second and third cathode connectors extend from an interior of the vacuum envelope to an exterior of the vacuum envelope; and a conductive coupler removably coupled to the receptacle and configured to electrically couple the receptacle to a first generator connector and a second generator connector, wherein the first electron emitter and the second electron emitter are configured to simultaneously produce electrons when a voltage potential is only applied across the first generator connector and the second generator connector.

2. The X-ray imaging system of claim 1, wherein the first electron emitter and the second electron emitter are configured to operate in parallel, series, or a single emitter by using different conductive couplers, wherein the conductive couplers are configured to:

operate the first electron emitter and the second electron emitter in parallel by:

a first parallel configured coupler coupled to the second cathode connector and configured to be coupled to the first generator connector, a second parallel configured coupler coupled to first cathode connector and configured to be coupled to the second generator connector, and a third parallel configured coupler coupled to third cathode connector and configured to be coupled to the second generator connector; and operate the first electron emitter and the second electron emitter in series by:

a first series configured coupler coupled to the first cathode connector and configured to be coupled to the first generator connector, and a second series configured coupler coupled to third cathode connector and configured to be coupled to the second generator connector; and operate only the first electron emitter by:

a first single emitter configured coupler coupled to the first cathode connector and configured to be coupled to the first generator connector, a second single emitter configured coupler coupled to second cathode connector and configured to be coupled to the second generator connector, and a third single emitter configured coupler coupled to third cathode connector and configured to be coupled to the second generator connector.

3. The X-ray imaging system of claim 1, wherein the first electron emitter and the second electron emitter are substantially the same size.

4. The X-ray imaging system of claim 1, wherein:

the cathode head further comprises a third electron emitter having a fifth connection location and a sixth connection location;

the receptacle further comprises a fourth cathode connector electrically coupled with the sixth connection location of the third electron emitter, and the third cathode connector is electrically coupled with the fifth connection location and wherein the fourth cathode connector extends from an interior of the vacuum envelope to an exterior of the vacuum envelope; and the conductive coupler includes a coupler further configured to electrically couple the fourth cathode connectors of the receptacle to a third generator connector.

5. The X-ray imaging system of claim 4, wherein the first electron emitter and the second electron emitter are substantially the same size and the third electron emitter includes a least one dimension smaller than a corresponding dimension of the first electron emitter and the second electron emitter.

6. The X-ray imaging system of claim 4, further comprising a generator including:

the first generator connector electrically coupled with a first electrical supply;

the second generator connector electrically coupled with an electrical common; and the third generator connector electrically coupled with a second electrical supply.

7. The X-ray imaging system of claim 4, further comprising:

a generator comprising:

the first generator connector electrically coupled with a first electrical supply; and the second generator connector electrically coupled with an electrical common; and a third generator connector electrically coupled with a second electrical supply; and at least one of the following:

the conductive coupler configured to electrically couple the first generator connector with the first cathode connector, to electrically couple the second generator connector with the third cathode connector, and to electrically couple the third generator connector with the fourth cathode connector; and the conductive coupler configured to electrically couple the first generator connector with the second cathode connector, to electrically couple the second generator connector with the first cathode connector and the third cathode connector, and to electrically couple the third generator connector with the fourth cathode connector.

8. The X-ray imaging system of claim 1, wherein:

the cathode head further includes a focusing structure having a seventh connection location;

the receptacle further comprises a fifth cathode connector electrically coupled with the seventh connection location of the focusing structure, wherein the fifth cathode connector extends from an interior of the vacuum envelope to an exterior of the vacuum envelope; and the conductive coupler further includes a fourth coupler configured to electrically couple the fifth cathode connector of the receptacle to a fourth generator connector.

9. The X-ray imaging system of claim 8, wherein a grid electrical supply is electrically coupled with the fourth generator connector.

10. The X-ray imaging system of claim 1, further comprising a generator, the generator comprising:

the first generator connector electrically coupled with a first electrical supply;

the second generator connector electrically coupled with a second electrical supply.

11. The X-ray imaging system of claim 1, wherein the conductive coupler is configured to electrically couple the first generator connector with the second cathode connector and to electrically couple a second generator connector with the first cathode connector and the third cathode connector.

12. The X-ray imaging system of claim 1, wherein the conductive coupler is configured to electrically couple the first generator connector with the first cathode connector and to electrically couple the second generator connector with the third cathode connector.

13. The X-ray imaging system of claim 1, wherein the first electron emitter and the second electron emitter are configured to simultaneously produce electrons in a parallel configuration when the conductive coupler includes:

a first coupler coupled to the second cathode connector and configured to be coupled to the first generator connector;

a second coupler coupled to the first cathode connector and configured to be coupled to the second generator connector;

a third coupler coupled to the third cathode connector and configured to be coupled to the second generator connector; and a fourth coupler coupled to the fourth cathode connector and configured to be coupled to a third generator connector.

14. The X-ray imaging system of claim 1, wherein the first electron emitter and the second electron emitter are configured to simultaneously produce electrons in a series configuration when the conductive coupler includes:

a first coupler coupled to the first cathode connector and configured to be coupled the first generator connector;

a second coupler coupled to the third cathode connector and to be coupled to the second generator; and a third coupler coupled to the fourth cathode connector and configured to be coupled to a third generator connector.

15. The X-ray imaging system of claim 1, wherein a number of generator connectors is less than a number of cathode connectors.

16. The X-ray imaging system of claim 1, wherein the first electron emitter and the second electron emitter include separate single filaments that are spaced apart from each other or positioned at least partially in separate filament slots.

* * * * *